US012800252B2

(12) United States Patent
Kras et al.

(10) Patent No.: US 12,800,252 B2
(45) Date of Patent: Nov. 17, 2026

(54) SUPPRESSOR WITH GAS CROSS FLOW AND REDUCED BACK PRESSURE

(71) Applicant: Sig Sauer, Inc., Newington, NH (US)

(72) Inventors: Krzysztof J. Kras, Freemont, NH (US); Evan Miller, Exeter, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 19/353,251

(22) Filed: Oct. 8, 2025

(65) Prior Publication Data

US 2026/0055984 A1 Feb. 26, 2026

Related U.S. Application Data

(63) Continuation of application No. 18/813,185, filed on Aug. 23, 2024, now Pat. No. 12,460,888.

(51) Int. Cl.
*F41A 21/30* (2006.01)

(52) U.S. Cl.
CPC ..... *F41A 21/30* (2013.01)

(58) Field of Classification Search
CPC ..... F41A 21/30
See application file for complete search history.

(56) References Cited

U.S. PATENT DOCUMENTS 5,029,512 A * 7/1991 Latka ..... F41A 21/30 89/14.4
7,308,967 B1 * 12/2007 Hoel ..... F41A 21/30 181/255
7,987,944 B1 * 8/2011 Brittingham ..... F41A 21/30 89/14.4
8,100,224 B1 * 1/2012 Olson ..... F41A 21/30 181/267
10,458,739 B2 * 10/2019 Smith ..... F41A 21/30
10,890,404 B2 1/2021 Petersen
11,255,623 B2 * 2/2022 Kras ..... F41A 21/30
11,680,764 B1 6/2023 Bray
11,686,547 B2 6/2023 Kras
11,859,932 B1 1/2024 Kras
12,173,975 B2 * 12/2024 Magee ..... F41A 21/30
12,264,889 B2 4/2025 Ricci
12,313,359 B2 5/2025 Dejessa
(Continued)

OTHER PUBLICATIONS

European Patent Office, International Search Report and Written Opinion issued in International Application No. PCT/US2025/042984 (Dec. 22, 2025).

*Primary Examiner* — Michelle Clement
(74) *Attorney, Agent, or Firm* — Secant IP, PLLC

(57) ABSTRACT

A suppressor for a firearm has a tubular housing extending along a bore axis from a proximal end to a distal end. A baffle stack within the hollow tubular housing extends along the bore axis and includes a tubular baffle wall with a plurality of baffle structures connected to an inside of the tubular baffle wall. The suppressor defines an inner volume inside of the tubular baffle wall and an outer volume between the tubular baffle wall and the hollow tubular housing. Flow-directing structures in the outer volume include pairs of diverging vanes and pairs of converging vanes. A conduit between adjacent baffle structures defines a gas flow pathway in a radially outer portion of the inner volume and defines an opening located between the adjacent baffle structures to direct gas flow across the bore axis.

20 Claims, 11 Drawing Sheets

Section B-B

(56) References Cited

U.S. PATENT DOCUMENTS

| | | | | |
|---|---|---|---|---|
| 12,313,360 | B2 | 5/2025 | Sjögren | |
| 12,618,631 | B2 * | 5/2026 | Shaw | F41A 21/30 |
| 2016/0018179 | A1 * | 1/2016 | Morris | F41A 21/30 181/223 |
| 2017/0160034 | A1 * | 6/2017 | Parker | F41A 21/30 |
| 2021/0018287 | A1 * | 1/2021 | Kada | F41A 21/30 |
| 2021/0041200 | A1 | 2/2021 | Kras et al. | |
| 2022/0049920 | A1 * | 2/2022 | Kras | F41A 21/30 |
| 2024/0288242 | A1 | 8/2024 | Kras et al. | |
| 2025/0189253 | A1 | 6/2025 | Spector et al. | |

* cited by examiner

Section A-A

Section B-B

SUPPRESSOR WITH GAS CROSS FLOW AND REDUCED BACK PRESSURE

RELATED APPLICATIONS

This application claims benefit under 35 U.S.C. § 120 as a continuation of U.S. patent application Ser. No. 18/813,185, filed on Aug. 23, 2024, the contents of which are hereby incorporated herein by reference in its entirety.

FIELD OF THE DISCLOSURE

This disclosure relates generally to muzzle accessories for use with firearms and more particularly to a suppressor particularly suited for use with a machine gun or a semi-automatic rifle

BACKGROUND

Firearm design involves many non-trivial challenges. For example, rifles, machine guns, and other firearms have faced particular complications with reducing the audible and visible signature produced upon firing a round, while also maintaining the desired shooting performance. A suppressor is a muzzle accessory that reduces the audible report of the firearm by slowing the expansion and release of pressurized gases from the barrel. Visible flash can also be reduced by controlling the expansion of gases leaving the barrel as well as by controlling how muzzle gasses mix with ambient air.

Figure 1:
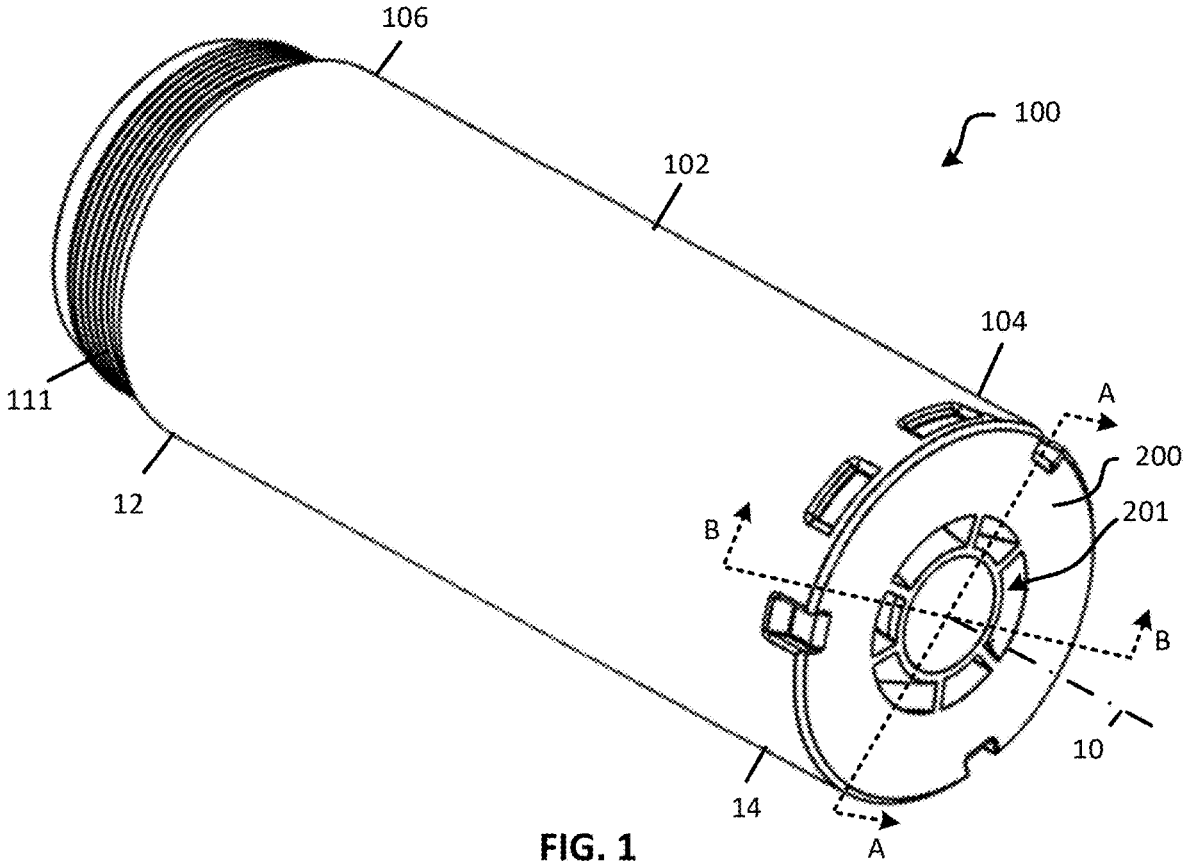
FIG. 1 illustrates a front perspective view of a suppressor, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

This disclosure is directed to a suppressor assembly having reduced gas back flow (commonly referred to as gas blow back or back pressure) as well as components of the suppressor assembly. In one example embodiment, a suppressor is configured for use with a machine gun and includes a baffle stack coaxially arranged within an outer housing, which can be cylindrical. The baffle stack has a cylindrical baffle stack wall, baffle structures (e.g., baffle cones) connected to the inside of the baffle stack wall and tapering rearwardly to a central axis. The region inside of the baffle stack wall defines an inner volume that includes the path of the projectile along the bore axis, which extends through central openings of each baffle structure. An outer volume is defined between the baffle stack wall and the outer housing such that the outer volume is concentric with and positioned radially outside of the inner volume. Flow-directing structures, such as vanes, are arranged in the outer volume to induce a non-linear, tortuous gas flow path through the outer volume. In some embodiments, at least some of the vanes are arranged in diverging and converging pairs of vanes. For example, vanes can be arranged in a herringbone-type pattern around the outside of the baffle stack wall. In some embodiments, the baffle stack wall defines one or more ports that allow gas flow between the outer volume and the inner volume. In one example, at least one port is arranged in the vertex between converging vanes. As a result of localized high pressure in the converging vanes, gases are directed from the outer volume to the inner volume, at least during part of the firing cycle.

Individual baffle structures, such as baffle cones, taper in a proximal direction from the baffle stack wall to a central opening on the bore axis. Baffle structures can have a frustoconical shape, can be a modified geometry from that shape, or can have other geometries. For example, the central opening at the proximal end of the frustoconical shape can have an offset profile as viewed from the side and/or can be inclined to the bore axis. At least some of the baffle structures include a conduit or chute connected to the baffle structure. The conduit provides an alternate flow path from baffle to baffle for gases in a radially outer region of the inner volume. The conduit extends between and connects adjacent baffle structures so as to define a gas flow pathway in a radially outer portion of the inner volume. The conduit can direct gases into a funnel-like structure that directs gases to flow crosswise to the bore axis. Conduits or chutes between adjacent baffle structures can be arranged in alternating sides of the inner volume to promote a sinuous gas flow path.

Flow-directing structures in the outer volume may include pairs of diverging vanes and pairs of converging vanes with respect to gases flowing distally through the suppressor. These flow-directing structures can promote gas flow between the inner volume and the outer volume by creating localized regions of reduced or increased pressure. For example, converging vanes adjacent the proximal end of the baffle stack can direct gases from the outer volume into the inner volume with a flow direction that crosses the bore axis. Pairs of diverging vanes can promote gas flow from the inner volume to the outer volume via ports defined in the baffle stack wall.

In some embodiments, the suppressor can include an integrated flash hider in the distal end of the suppressor assembly to reduce the visible signature. In one example, the flash hider is part of an end cap and includes a first flash hider portion and a second flash hider portion coaxially arranged with the first flash hider portion. The first flash hider portion vents gases directly from the inner volume, such as gases flowing along the bore axis. The second flash hider portion is located radially outside of the first flash hider portion and can be configured to vent gases directly from the outer volume, from a radially outer portion of the inner volume, or both. In some embodiments, the second flash hider portion requires that gases take a tortuous flow path. In some such embodiments, the second flash hider portion has no direct line of sight into the inner volume or into outer volume of the suppressor from outside of the suppressor.

When the firearm is discharged, the projectile travels through the suppressor along the bore axis, followed by combustion gases. Gases initially expand in a blast chamber in the proximal end portion of the suppressor. A first portion of combustion gases continues along the bore axis and enters the baffle stack through a central opening in the first baffle, sometimes referred to as the blast baffle. A second portion of combustion gases flows into the outer volume between the baffle stack and outer housing. The second portion of gases may include gases deflected outward and away from the central axis by the blast baffle, for example. Gases in the outer volume are largely isolated from and can vent semi-independently of gases flowing through the inner volume.

To more evenly fill the suppressor, and to promote gas flow through most of the suppressor volume, some gases can be directed across the bore axis to create or enhance a sinuous flow. This sinuous flow path has an elongated length that delays the exit of gases from the inner volume. In doing so, the sound signature can be reduced. In one embodiment, combustion gases are directed in an off-axis direction through the baffle stack as a result of one or more features. A baffle structure can have a central opening in a plane that is inclined to the central axis, thereby promoting off-axis flow through the central opening. Alternately, or in addition, the central opening to the generally conical baffle structure can have a step, an offset, a notch, or otherwise can define a non-circular opening, for example, to promote gas flow through the opening in a direction transverse to the central axis. In one such embodiment, the central opening is circular as viewed along the central axis and has a first half of the opening that is axially offset from an opposite second half of the opening so as to provide an enlarged area as viewed transversely through the opening.

In some embodiments, ports defined in the baffle stack wall direct gases from the inner volume to the outer volume, or vice versa. For example, the baffle stack wall can define ports so that gases flow in a direction substantially perpendicular to the bore axis (e.g., ±10°). Such port(s) can be positioned to enhance gas flow across the bore axis by intersecting gases that flow through the central opening of a baffle. Also, gases in a radially outer portion of the inner volume can pass from one baffle to the next baffle via a conduit that extends between openings in the cone-like baffle structures. When used alone or in combination with other flow-directing features, the baffle stack promotes and/or amplifies a sinuous flow through the inner volume.

Features of the suppressor can be employed to amplify a sinuous or otherwise off-axis gas flow through the suppressor's inner volume, a tortuous flow path through the outer volume, and multiple gas flow paths through the flash hider. Various features can be used individually or in combination to provide a combination of suitable attenuation of the audible signature, attenuation of the visible signature, and reduction in back flow of pressurized gases into the firearm's receiver, particularly with some suppressors having an overall diameter of greater than two inches. Numerous variations and embodiments will be apparent in light of the present disclosure.

GENERAL OVERVIEW

As noted above, non-trivial issues may arise that complicate weapons design and performance of firearms. For instance, one non-trivial issue pertains to the fact that the discharge of a firearm normally produces an audible and visible signature resulting from rapidly expanding propellant gases and from the projectile leaving the muzzle at a velocity greater than the speed of sound. It is generally understood that attenuating the audible report may be accomplished by slowing the rate of expansion of the propellant gases. Reducing the visible signature or visible flash also can be accomplished by controlling the expansion of gases exiting the muzzle. Reducing flash is a function of temperature, pressure, barrel length, suppressor length, and the type of ammunition being fired, among other factors. However, attenuating muzzle flash can adversely affect the performance of sound attenuation and vice versa.

Suppressors can have additional challenges associated with reducing visible flash and attenuating sound. In some suppressor designs, for example, slowing down the expansion and release of combustion gases from the muzzle can undesirably result in trapping and delayed release of pressurized gas from the suppressor, which results in a localized volume of high-pressure gases. As a natural consequence, the pressurized gases in the barrel or suppressor follow the path of least resistance and travel out of the barrel, exiting the chamber near the operator's face. Such condition is generally not problematic in the case of a bolt-action rifle because the operator opens the bolt to eject the spent casing in a time frame that is much greater than the time required for the gases in the suppressor to disperse through the distal (forward) end of the suppressor. However, in the case of a semi-automatic rifle, automatic rifle, or a machine gun, the bolt opens very quickly after firing (e.g., within 1-10 milliseconds) to reload the firearm for the next shot. In this short time, pressurized gases remain in the suppressor and the barrel. Some of the gases remaining in the barrel and the suppressor therefore follow the path of least resistance back through the barrel and out through the chamber towards the operator's face, rather than following the tortuous path through the suppressor. To avoid introducing particulates and combustion residue to the chamber, and to avoid combustion gases being directed towards the operator's face, it would be desirable to reduce the pressure build up within the suppressor and therefore reduce or eliminate back flow into the receiver of autoloading firearms.

Thus, reducing the visible signature while also reducing the audible signature of a firearm presents non-trivial challenges. To address these challenges and others, and in accordance with some embodiments, the present disclosure relates to a suppressor having reduced gas back flow, a suppressor baffle or baffle stack for use in a suppressor assembly, and a suppressor with an integrated flash hider.

Compared to traditional baffle-type suppressors, a suppressor of the present disclosure can reduce localized volumes of high-pressure gas and the resulting flow of combustion gases backward through the barrel and into the rifle's receiver after firing, such as may occur in semiautomatic and automatic rifles. The inner and outer volumes divide the gases into inner and outer volumes that can, in some embodiments, better expand to fill and flow through the entire suppressor volume.

A suppressor (or a portion thereof) according to the present disclosure can be manufactured by molding, casting, machining, 3-D printing, or other suitable techniques. For example, additive manufacturing—also referred to as 3-D printing—can facilitate manufacture of complex geometries that would be difficult or impossible to make using conventional machining techniques. One additive manufacturing method is direct metal laser sintering (DMLS).

As will be appreciated in light of this disclosure, and in accordance with some embodiments, a suppressor assembly configured as described herein can be utilized with any of a wide range of firearms, such as, but not limited to, machine guns, semi-automatic rifles, automatic rifles, short-barreled rifles, and submachine guns. Some embodiments of the present disclosure are particularly well suited for use with a belt-fed machine gun and automatic fire rifles. Suitable host firearms and projectile calibers will be apparent in light of this disclosure.

Although generally referred to a suppressor herein for consistency and case of understanding the present disclosure, the disclosed suppressor is not limited to that specific terminology and alternatively can be referred to as a silencer, sound attenuator, a sound moderator, a signature attenuator, or other terms. Also, although generally referred to herein as a baffle structure, the disclosed baffles are not limited to that specific terminology and alternately can be referred to, for example, as a baffle cone, a tapered wall, or other terminology, even if such structure follows or does not follow a true conical geometry. Further, although generally referred to herein as a flash hider for consistency and ease of understanding the present disclosure, the disclosed flash hider is not limited to that specific terminology and alternatively can be referred to, for example, as a flash suppressor, a flash guard, a suppressor end cap, or other terms. Numerous configurations will be apparent in light of this disclosure.

Example Suppressor Configurations

Figure 2:
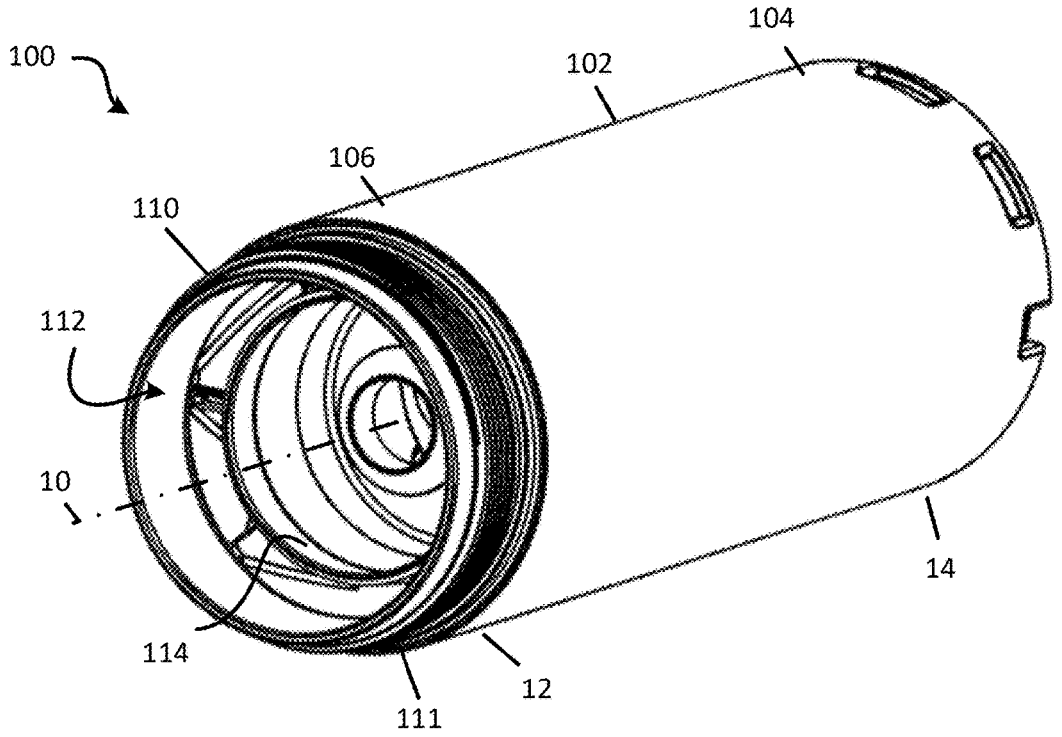
FIG. 2 illustrates a rear perspective view of the suppressor of FIG. 1 and shows a blast chamber in the proximal end portion of the suppressor, in accordance with an embodiment of the present disclosure.

FIGS. 1 and 2 illustrate front and rear perspective views, respectively, of a suppressor assembly 100 (or simply "suppressor" 100), in accordance with an embodiment of the present disclosure. In this example, the suppressor 100 has an outer housing 102 with a cylindrical shape that extends along a bore axis 10 from a proximal end portion 12 to a distal end portion 14. The diameter of the outer housing 102 can be 1.5-3.0 inches in some embodiments, including 1.5-2.0 inches, 2.0-2.5 inches, 2.5-3.0 inches, about 1.75 inch, and about 2.25 inch. The cylindrical shape is not required, and other geometries are acceptable, including a cross-sectional shape that is hexagonal, octagonal, rectangular, oval, or elliptical, for example. An outer housing 102 extends between a distal housing end portion 104 and a proximal housing end portion 106. The proximal housing end portion 106 optionally includes a threaded portion 111 that can be used to connect the suppressor 100 to an adapter or quick-disconnect assembly (not shown) suitable for attachment to a firearm barrel or to a flash hider attached to the firearm barrel, for example. An endcap 200 with an integral flash hider 201 is retained in the distal end portion 14.

The proximal end portion 12 defines a blast chamber 112 as can be seen in FIG. 2. In some embodiments, the blast chamber 112 is sized to accommodate a muzzle brake, flash hider, or similar muzzle attachment attached to the barrel of the firearm. For example, the suppressor 100 is constructed to be installed on a muzzle attachment on the firearm barrel, where the muzzle attachment is received in the blast chamber 112; however, no such muzzle attachment is required for effective operation of suppressor 100. In one example embodiment, the blast chamber 112 has an axial length from 0.5 inch to about 3 inches. Numerous variations and embodiments will be apparent in light of the present disclosure.

Figure 3A:
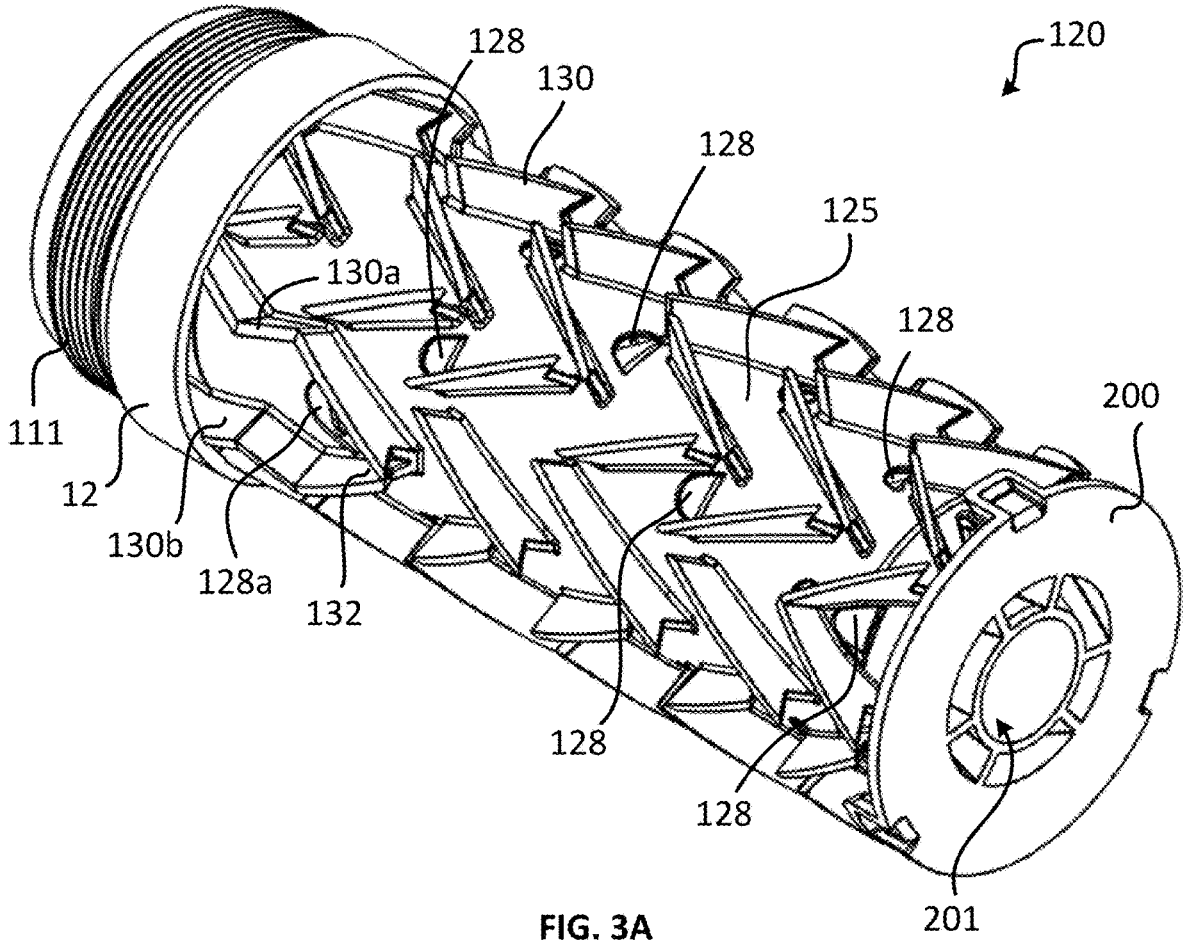
FIG. 3A illustrates a front perspective view of a baffle stack with its outer chamber of a suppressor assembly, in accordance with an embodiment of the present disclosure.
Figure 3B:
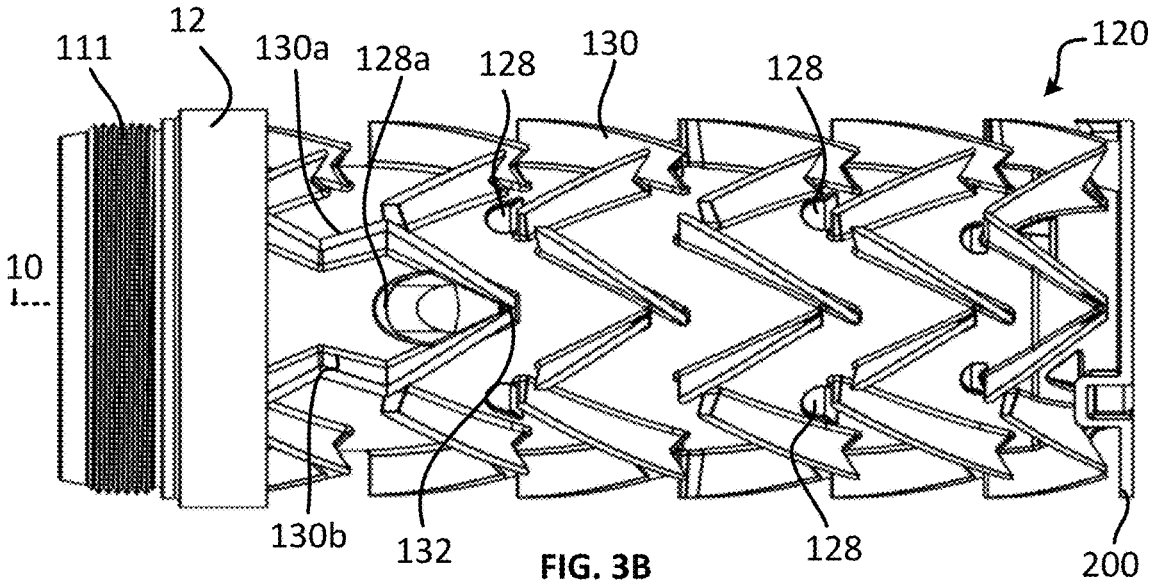
FIG. 3B illustrates a side view of the baffle stack of FIG. 3A.

FIGS. 3A and 3B illustrate a front perspective view and a side view, respectively, of a baffle stack 120, in accordance with an embodiment of the present disclosure. In this example, the baffle stack 120 is made as a single, monolithic part with a baffle stack wall 125 and flow-directing features 130 (e.g., vanes) on the outside of the baffle stack wall 125. The baffle stack 120 includes a proximal portion 12 of the suppressor 100. An endcap 200 can be made together as part of the baffle stack 120 or can be a separate component that is assembled with the baffle stack 120 and outer housing 102. When assembled, the outer housing 102 can abut the proximal portion 12 and be retained by the end cap 200, in accordance with some embodiments.

The baffle stack wall 125 defines one or more ports 128, some of which are positioned between diverging vanes and others which are positioned between converging vanes. Ports enable gas flow between the inner volume and the outer volume of the suppressor. As best seen in FIG. 3B, the baffle stack 120 defines a proximal port 128*a* positioned in a vertex 132 between converging vanes. In this example, the proximal port 128*a* is fed by gases that flow around the proximal end portion 127 or rim of the baffle stack wall 125 and into the outer volume. These gases tend to have a relatively high velocity and are guided by a pair of elongated flow-directing structures 130*a*, 130*b* to the proximal port 128*a* and into the inner volume. In this example, the flow-directing structures 130*a*, 130*b* leading to the proximal port 128*a* each has a zig-zag shape and a generally converging shape that converges around the proximal port 128*a* to a vertex 132. Upon passing through the proximal port 128*a*, for example, gases flow across the bore axis 10 in a jet and intersect gases flowing along the bore axis 10. As a result, the proximal port 128*a* promotes off-axis flow of gases that have passed through the blast baffle 120*a*. In this example, the proximal port 128*a* is larger in size compared to other ports and accommodates a comparatively greater volume of gas. This greater volume of gas provides a strong flow of gases across the bore axis 10 to disrupt gas flow and promote off-axis gas flow in a proximal portion of the suppressor 100. In some embodiments, the proximal port 128*a* has an area that is from 100% to 400%, 125-200%, 125%-250%, 30%-35%, or about 150% of the area of the central opening 136 of the blast baffle 120*a*.

Figure 4:
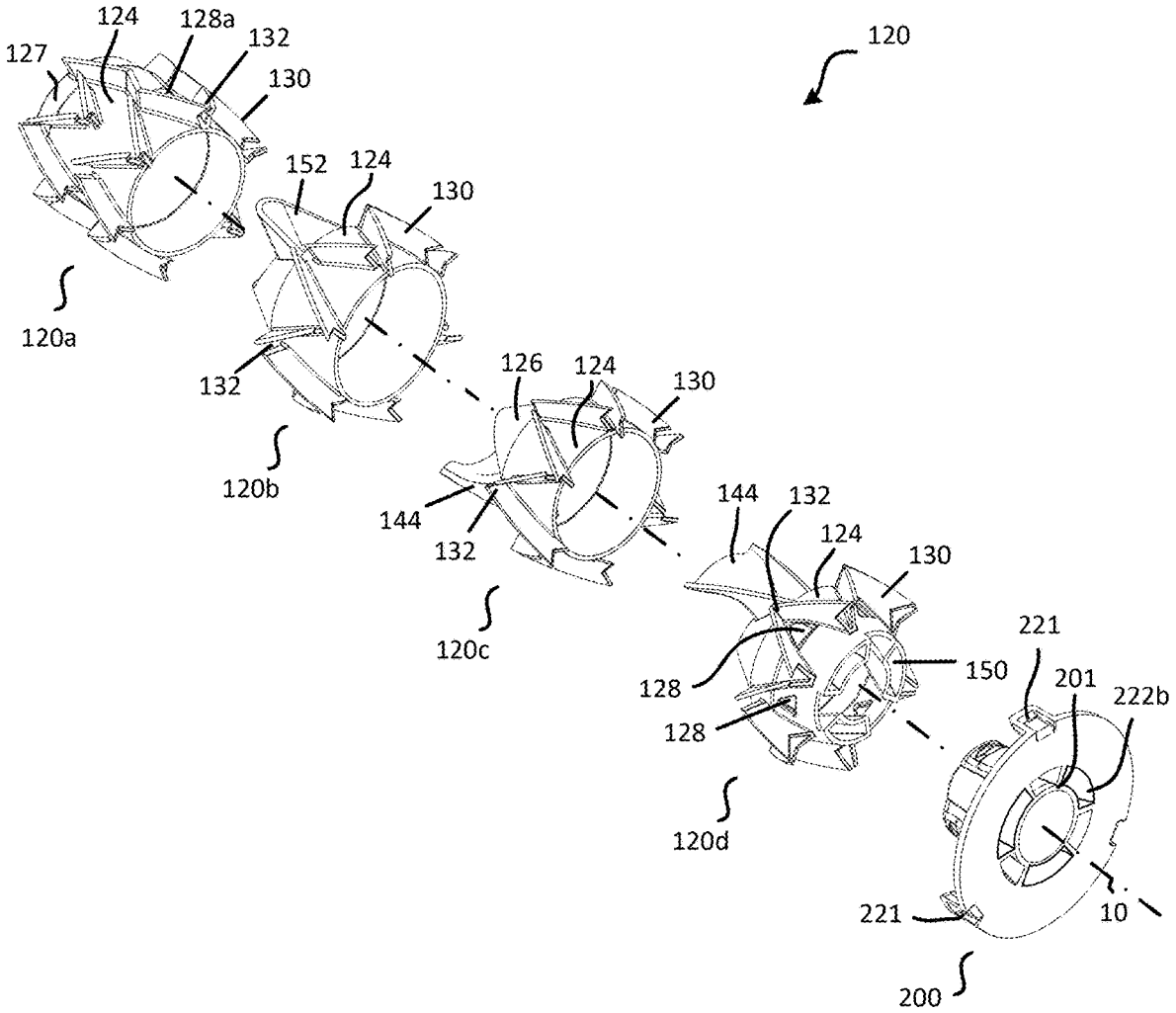
FIG. 4 illustrates an exploded, perspective view of sections of a baffle stack, in accordance with an embodiment of the present disclosure.

FIG. 4 illustrates an exploded, front perspective view of a baffle stack 120 that includes a plurality baffle stack segments 120*a*-120*d*, in accordance with an embodiment of the present disclosure. In this example, the baffle stack 120 is illustrated as having an endcap 200 and four segments 120*a*-120*d* that can be assembled so that the baffle wall segment 124 of each segment connects to form a continuous baffle stack wall 125. In embodiments having individual baffles, the baffle wall segments 124 can abut or connect to one another to define a tubular baffle stack wall 125. The baffle wall segments 124 can be connected to one another by welding, a threaded interface, or an interference fit, for example.

In other embodiments, such as shown in FIGS. 3A-3B, the entire baffle stack 120, or portions thereof, can be formed as a single monolithic structure. For example, the baffle stack 120 can be made using additive manufacturing techniques such as direct metal laser sintering (DMLS). In embodiments where the baffle stack 120 is a monolithic structure, the baffle stack wall 125 may not distinctly define individual baffle wall segments 124, but the baffle stack 120 can be considered as having baffle portions corresponding to the equivalent structure formed as distinct baffles 120. Principles discussed herein for a baffle stack 120 having distinct baffles 120 can apply to a baffle stack 120 formed as a unitary structure and vice versa. The structure of individual baffles 120 is discussed in more detail below.

The baffle stack 120 of FIG. 4 includes a first baffle or blast baffle segment 120*a*, a second baffle segment 120*b*, a third baffle segment 120*c*, a fourth baffle segment or final baffle segment 120*d*, and an endcap 200. The baffle stack 120 can include more or fewer segments or baffle sections as deemed appropriate for a particular application. One such embodiment is shown in FIGS. 3A-3B, which includes five baffle segments. Each baffle stack segment 120*a*-120*d* includes a cylindrical baffle wall segment 124 arranged coaxially with the central axis 102 and having flow-directing structures 130, such as vanes, on the outside of the wall segment 124. When the baffle stack 120 is made as a single, monolithic structure, the baffle stack wall 125 similarly has a tubular geometry with flow-directing structures 130 on the outside. In various examples, the flow-directing structures 130 can be connected to one or both of an outer surface of the baffle stack wall 125 and an inner surface of the outer housing 102. The flow-directing structures 130 can be vanes, walls, ridges, partitions, or other obstructions that cause collisions with flowing gases and result in a non-linear gas flow through the outer volume 109. In some examples, flow-directing structures 130 can include alternating vanes that extend part way the outer housing 102 and the baffle stack wall 125, where the alternating position of the flow-directing structures 130 can define an oscillating flow path for the gases as they flow towards exit at the distal end of the suppressor 100.

Similar to as shown in FIGS. 3A-3B, the flow-directing structures 130 shown in FIG. 4 are configured as vanes having a planar or helical shape. At least some of the vanes are arranged in a zig-zag or herringbone-type pattern around the outside of the wall segment 124. Each baffle wall segment 124 has vanes that extend transversely to the bore axis 10 and have an axial length roughly equal to the axial length of the baffle wall segment 124. In some instances, part of a vane may extend beyond the end of the baffle wall segment 124. Ends of adjacent vanes can be directed towards each another to make a V shape or vertex 132, even though the ends of vanes may or may not make contact or may not close the vertex 132. Each vertex 132 is positioned to point generally along the bore axis 10, either distally or proximally. In some embodiments, flow-directing structures 130 include vanes arranged generally in a circumferential grid with vertices 132 arranged along lines that are parallel to the bore axis 10, and in rows arranged circumferentially around the baffle stack 120. Vanes defining a vertex 132 pointing proximally can be referred to as diverging vanes and vanes defining a vertex 132 pointing distally can be referred to as converging vanes.

In this example, the blast baffle segment 120*a* has a greater axial length-approximately twice the length-compared to other baffle segments in the baffle stack 120 and includes two rows of flow-directing structures 130 around the wall segment 124. A proximal end portion 127 or rim of the blast baffle segment 120*a* tapers radially inward moving in a proximal direction, so that gases impinging upon or flowing over the proximal end portion 127 are directed radially outward towards the outer volume 109. The baffle structure 126 (sometimes referred to as the blast baffle) of the blast baffle segment 120*a* is contained within the baffle wall segment 124.

The second baffle segment 120*b* defines a funnel 152 that is configured to receive gases flowing through the proximal port 128*a* of the blast baffle segment 120*a*. The funnel 152 on the second baffle segment 120*b* has a conical geometry or some other shape that reduces in size moving radially inward; as a result, gases flowing into the funnel 152 are compressed and exit from the funnel 152 at a higher flowrate and do so in a direction that is crosswise to the central axis 10. The third baffle segment 120*c* and the fourth or final baffle segment 120*d* each define a conduit 144, such as a chute or funnel, that is configured to receive gases flowing in a radially outer portion of the inner volume 108 or in the outer volume 109. The conduit 144 is configured to direct that gas into the inner volume 108 in a direction crosswise to the central axis 10. The third baffle segment 120*c* and the fourth or final baffle segment 120*d* each define a conduit 144 that receives gases from a radially outer portion of the inner volume 108 and directs those gases across the central axis 10. As such, the conduits 144 on the third baffle segment 120*c* and final baffle segment 120*d* extend rearward in an axial direction. The conduit 144 on the final baffle segment 120*d* is configured to direct gases from the inner volume 108 to flow through the flash hider 201 on the endcap 200. In this example, part of the flash hider 201 is included in the final baffle segment 120*d*. Baffles 120 and endcap 200 will be discussed in more detail below.

Gas ports 128 can be positioned to permit gases to pass between the outer volume 109 and the inner volume 108. In some embodiments, the pressure is greater in the outer volume 109, resulting in gas ports 128 functioning as inlet ports for gas flow from the outer volume 109 to the inner volume 108. Note, however, that gas dynamics within the suppressor 100 depend on many factors and the gas flow through various ports could reverse directions during the firing cycle. For example, gases may flow in either direction between the inner volume 108 and the outer volume 109. As shown in FIG. 4, the final baffle segment 120*d* defines a plurality of gas ports 128 positioned between vanes 130. During higher gas pressures in the outer volume 109, at least during some phases of the firing cycle, these gas ports 128 allow gases in the outer volume 109 to enter the inner volume 108 or directly flow into the adjacent flash hider outer volumes 222*b* from where they can exit the suppressor.

The flash hider 200 can be installed adjacent to, abutting, or overlapping with the final baffle segment 120*d* with portions of the flash hider 200 received within the baffle wall segment 124. The flash hider 200 can be secured to the baffle stack 120 by welding, threaded engagement, a frictional fit, or other by engagement with the outer housing 102. Optionally, the flash hider 200 defines recesses 221 in the distal end portion to facilitate engagement with a spanner or other tool used to assemble the suppressor 100 with the mount 110, or to screw the suppressor 100 onto the barrel or barrel attachment. Example embodiments of a flash hider 200 are discussed in more detail below.

Figure 5A:
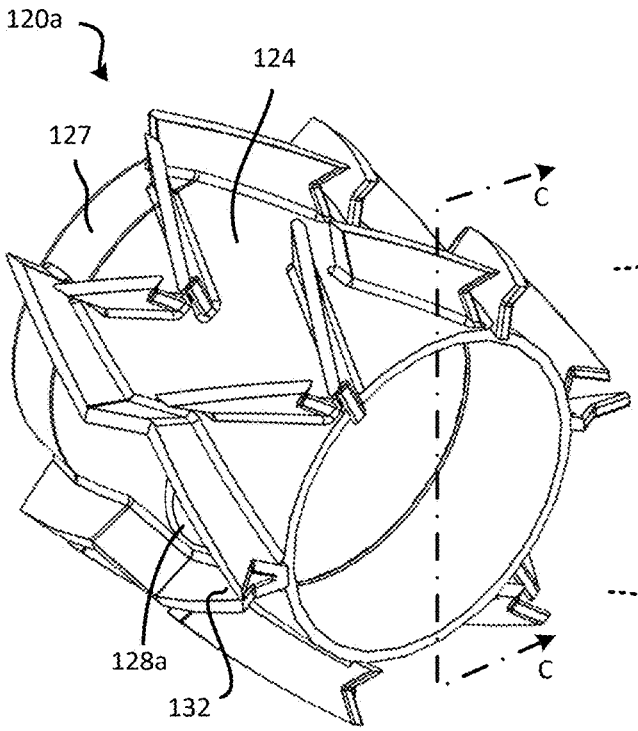
FIGS. 5A-5D illustrate various views of a blast baffle of the baffle stack shown in FIG. 3, in accordance an embodiment of the present disclosure.
Figure 5B:
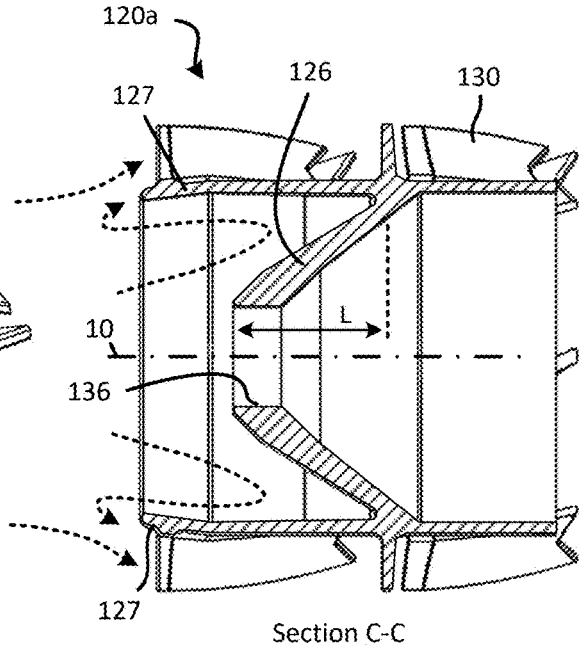
Figure 5C:
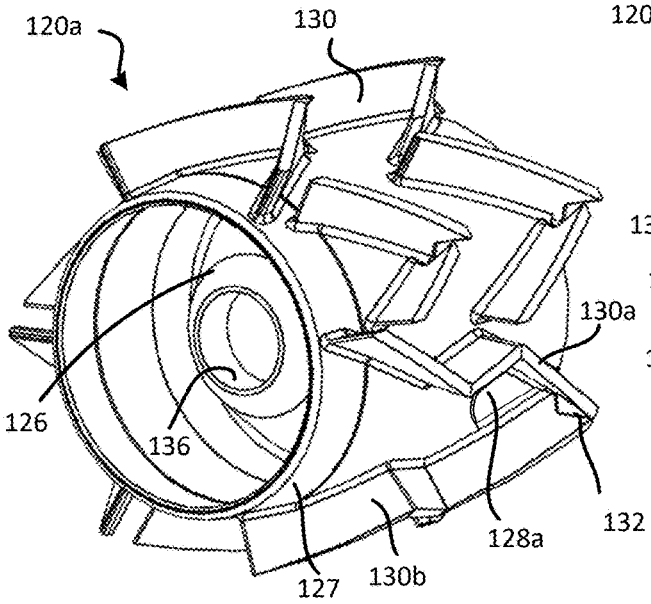

Referring now to FIGS. 5A-5D, a front perspective view, a side view of a longitudinal section, a rear perspective view, and a side view, respectively, illustrate a blast baffle segment 120*a*, in accordance with an embodiment of the present disclosure. The section of FIG. 5B is viewed along line C-C of FIG. 5A. The blast baffle segment 120*a* has a cylindrical baffle wall segment 124. A generally conical baffle structure 126, also referred to as a blast baffle for this baffle segment, is connected to the inside of the baffle wall segment 124 and extends rearwardly as it tapers in size to the central opening 136 aligned with the bore axis 10. As noted above, the central opening 136 provides a pathway for a projectile along the bore axis 10. In this example, the baffle structure 126 generally has a frustoconical geometry with a linear taper. In the blast baffle segment 120*a*, the baffle structure 126 is contained entirely within the baffle wall segment 124 due to the increased length of the baffle wall segment 124. Compared to baffle segments 120*b*-120*d*, the baffle wall segment 124 of the blast baffle segment 120*a* extends rearward from its connection with the baffle structure 126 (here a cone). As shown, the baffle wall segment 124 extends rearward beyond the entirety of the baffle structure 126 and the central opening 136 to the baffle structure. In this example, the baffle wall segment 124 extends rearward beyond the central opening 136 by 50%-100% more than the axial length L of the baffle structure 126, including 60%-80%, or about 70% more. The proximal end portion 127 or rim of the blast baffle 120*a* tapers slightly moving in a proximal direction. As a result, a portion of gases impinging on the proximal end portion 127 are directed to flow into the outer volume 109. In addition, gases impinging on the baffle structure 126 are diverted radially outward and tend to reverse direction and then flow around the proximal end portion 127 of the baffle stack wall 125 and into the outer volume 109. In addition to absorbing energy of the gases, this flow path increases the dwell time of gases in the suppressor 100 and results in a more complete burn of combustion gases. In turn, flash is reduced.

Figure 5D:
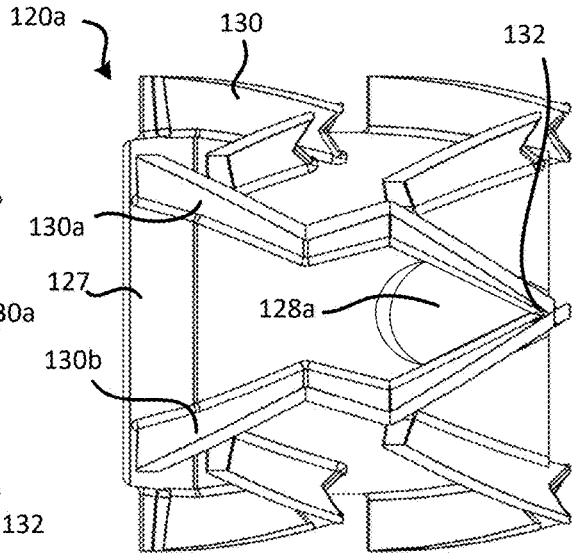

As best seen in FIG. 5D, the blast baffle segment 120*a* includes a proximal port 128*a* between converging vanes 130*a*, 130*b*. The proximal port 128*a* is fed by gases flowing into the outer volume 109 and directed by elongated vanes 130*a*, 130*b*. Here, the proximal port 128 has a greater size compared to other ports 128 and the volume between vanes 130*a* and 130*b* is greater than that between other pairs of converging vanes 130. In some embodiments, the proximal port 128*a* has an area in a range of 100%-300% of the area of the central opening 136 of the blast baffle 126.

Figure 6A:
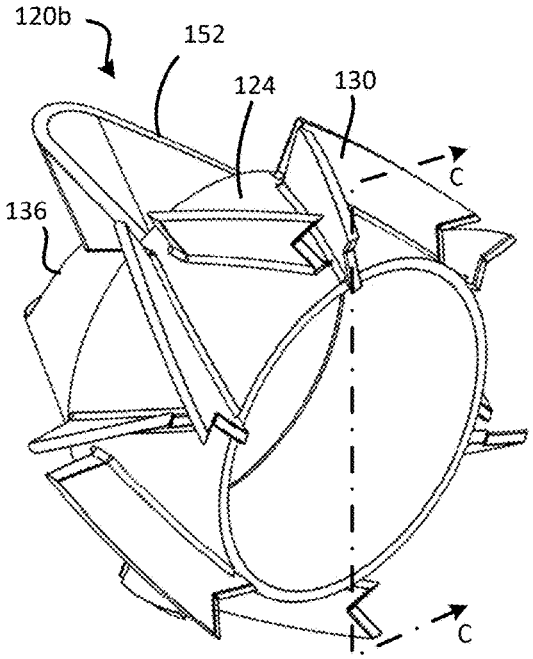
FIGS. 6A-6D illustrate various views of a proximal baffle of the baffle stack shown in FIG. 3, in accordance an embodiment of the present disclosure.
Figure 6B:
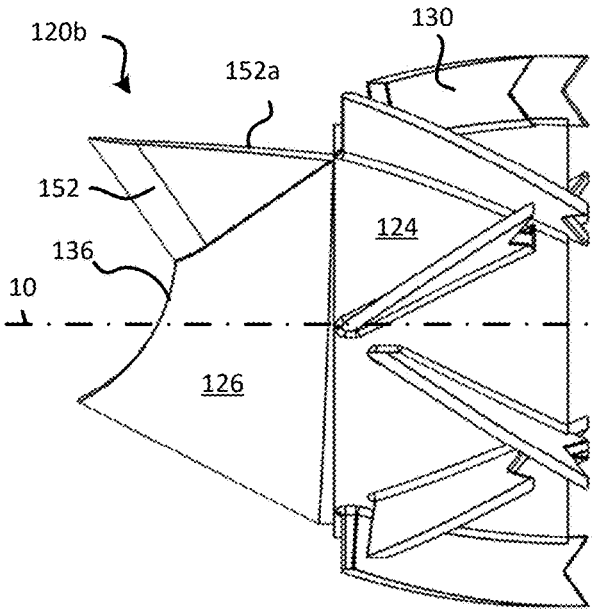
Figure 6C:
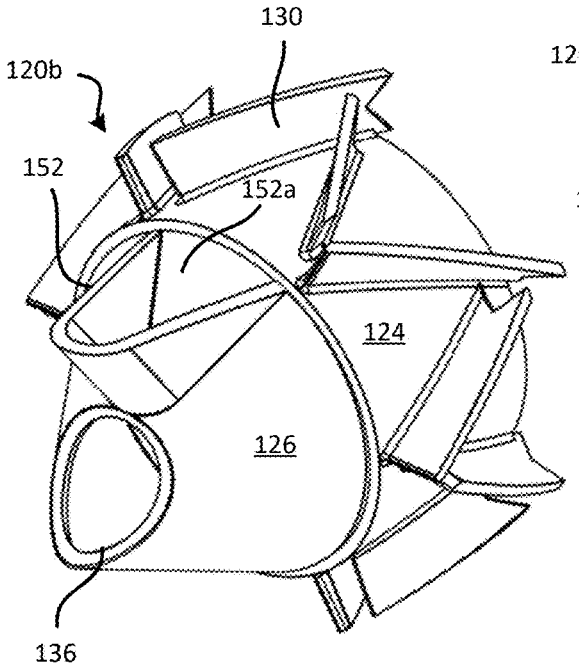
Figure 6D:
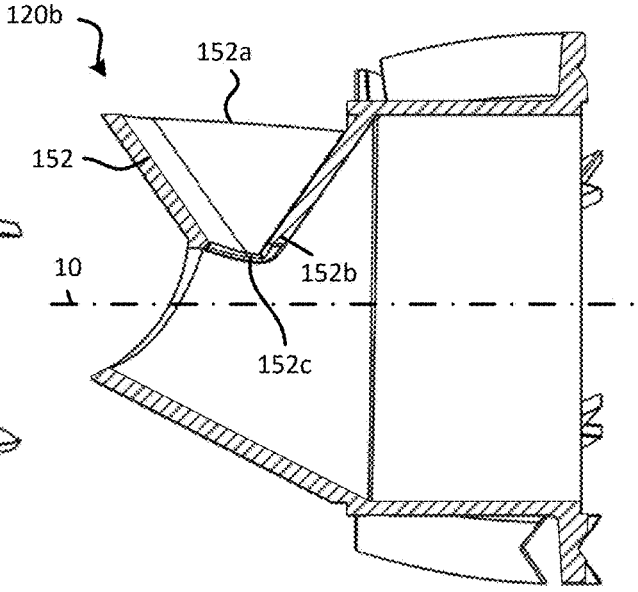

FIGS. 6A-6D illustrate a front perspective view, a side view, a rear perspective view, and a longitudinal section as viewed along line C-C of FIG. 6A, respectively, and show a second baffle segment 120*b* as illustrated in the exploded view of FIG. 4. The second baffle segment 120*b* has a cylindrical baffle wall segment 124 with flow-directing features 130 arranged in a zig-zag pattern around the outside of the baffle wall segment 124. A cone-like baffle structure 126 extends rearwardly from a proximal end of the baffle wall segment 124 and tapers to a central opening 136. As can be seen in FIG. 6B, the central opening 136 is generally inclined to the bore axis 10 and has a curved profile as viewed from the side. A linear profile, a stepped profile, or some other profile is acceptable for the central opening 136. A funnel 152 is connected to the baffle structure 126 between the central opening 136 and the baffle wall segment 124 and has a larger first end 152*a* defining a mouth configured to receive gases from the proximal port 128*a*. For example, the first end 152*a* is oriented in a plane that is generally parallel to the bore axis 10. As can be seen in FIG. 6D, the funnel 152 tapers to a smaller second end 152*b* defining an exit opening 152*c* directed crosswise to the bore axis 10. For example, the exit opening 152*c* is in a plane that is parallel to the bore axis 10. Due to the converging geometry of the funnel 152 from the first end 152*a* to the second end 152*b*, gases entering the funnel 152 through the proximal port 128*a* are directed to pass through the exit opening 152*c* in a direction that is perpendicular or substantially perpendicular (e.g., ±10°) to the bore axis 10. In this example, the exit opening 152*c* is configured to direct gases perpendicular to or slightly rearward across the bore axis 10.

Figure 7A:
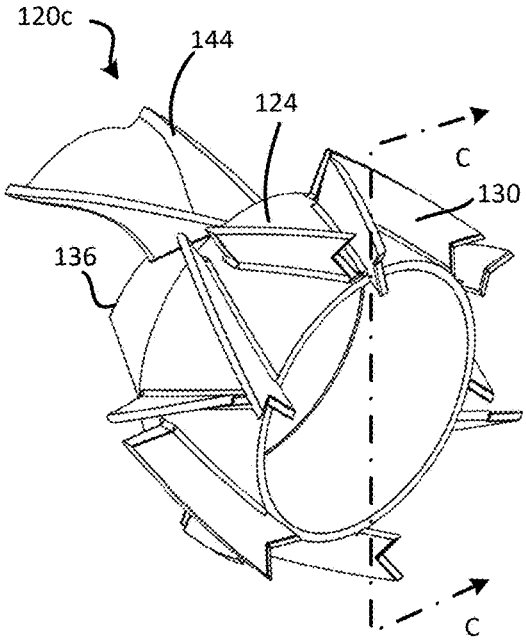
FIGS. 7A-7D illustrate various views of another baffle of the baffle stack shown in FIG. 3, in accordance an embodiment of the present disclosure.
Figure 7B:
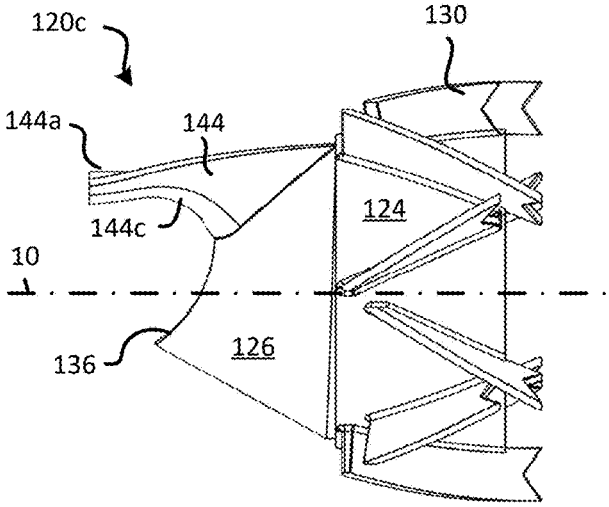
Figure 7C:
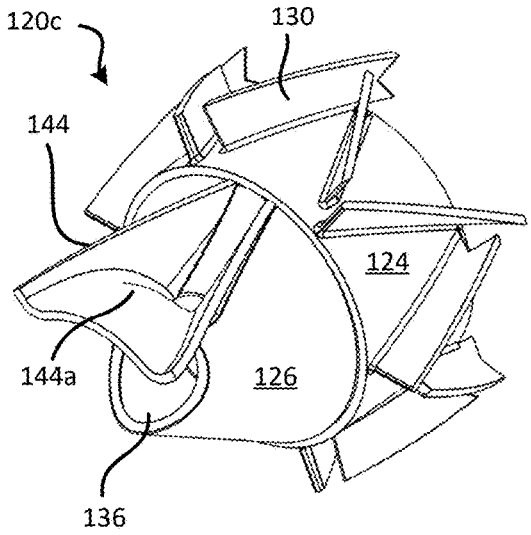
Figure 7D:
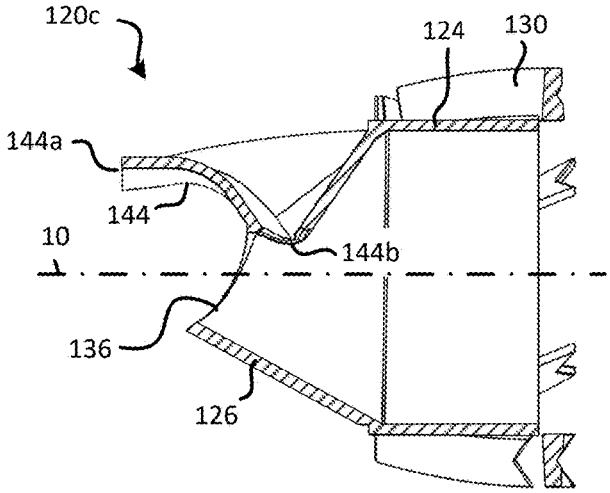

FIGS. 7A-7D illustrate a front perspective view, a side view, a rear perspective view, and a longitudinal section as viewed along line C-C of FIG. 7A, respectively, and show a third baffle segment 120*c* as illustrated in the exploded view of FIG. 4. The third baffle segment 120*c* has a cylindrical baffle wall segment 124 with flow-directing features 130 arranged in a zig-zag pattern around the outside of the baffle wall segment 124. A baffle structure 126 extends rearwardly from a proximal end of the baffle wall segment 124 and tapers to a central opening 136. As can be seen in FIG. 7B, the central opening 136 has a curved profile as viewed from the side, and the central opening 136 is inclined to the bore axis 10. A linear profile, a stepped profile, or some other profile is acceptable for the central opening 136. A conduit 144 is connected to the cone-like baffle structure 126 between the central opening 136 and the baffle wall segment 124 and has a mouth 144*a* that is open from the rear. A radially outer wall of the conduit 144 (e.g., top wall as shown in this orientation) is connected to the baffle stack wall 125 in an assembled form, in accordance with some embodiments. An exit 144*b* of the conduit 144 is directed crosswise to the bore axis 10. Due to the converging geometry of the conduit 144 from the mouth 144*a* to the exit 144*b*, gases entering the conduit 144 from the mouth 144*a* are directed to pass through the exit 144*b* in a direction that is perpendicular or substantially perpendicular (e.g., ±10°) to the bore axis 10.

Figure 8A:
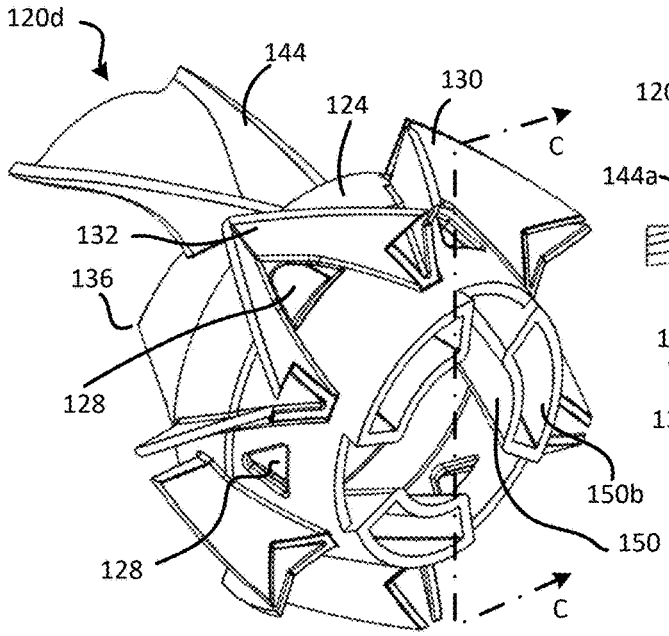
FIGS. 8A-8D illustrate various views of a distal baffle of the baffle stack shown in FIG. 3, in accordance an embodiment of the present disclosure.
Figure 8B:
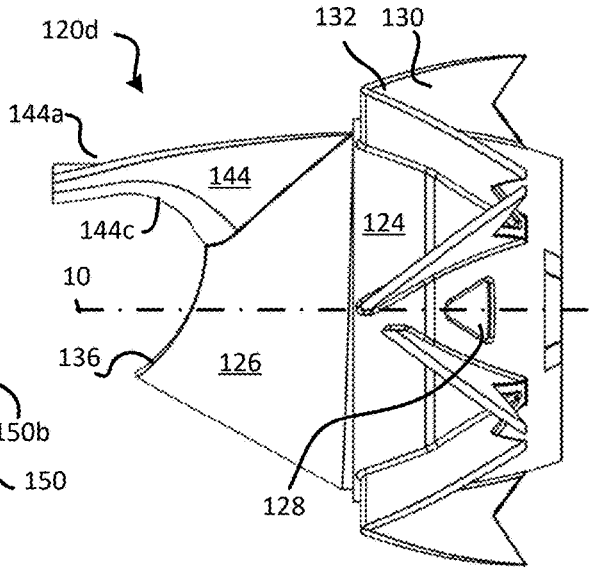
Figure 8C:
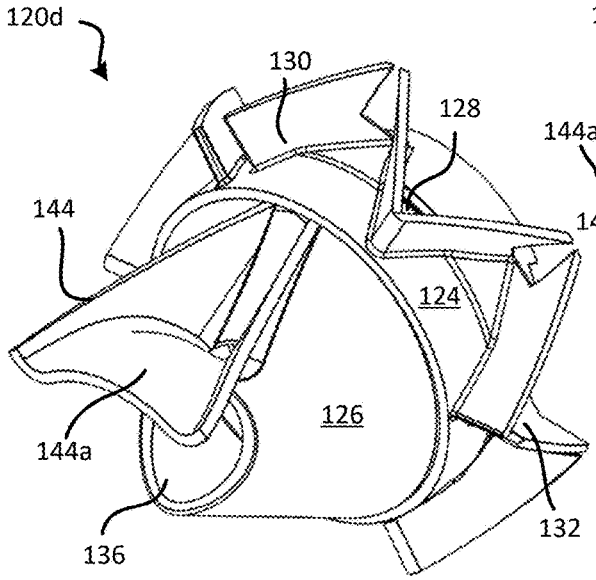
Figure 8D:
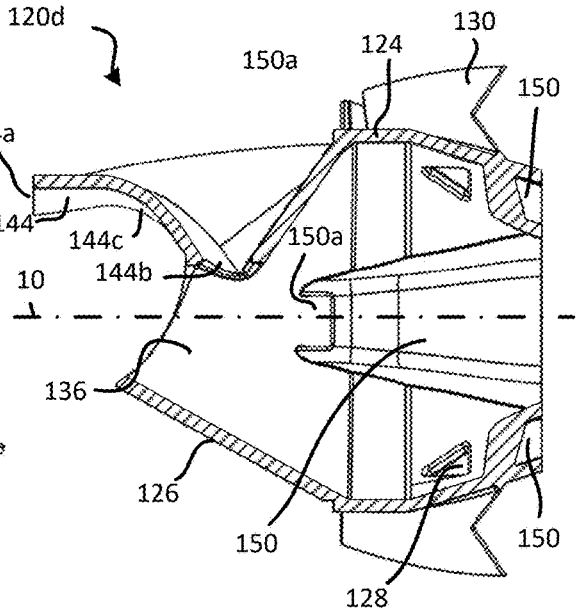

FIGS. 8A-8D illustrate a front perspective view, a side view, a rear perspective view, and a longitudinal section as viewed along line C-C of FIG. 8A, respectively, and show a final baffle segment 120*d* as illustrated in the exploded view of FIG. 4. The final baffle segment 120*d* has a baffle wall segment 124 with flow-directing features 130 arranged in a zig-zag pattern around the outside of the baffle wall segment 124. The baffle wall segment 124 has a cylindrical portion and a conical portion extending forward from the cylindrical portion. The conical portion reduces in diameter moving in a distal direction. A cone-like baffle structure 126 extends rearwardly from a proximal end of the baffle wall segment 124 and tapers to a central opening 136. As can be seen in FIG. 8B, the central opening 136 has a curved profile as viewed from the side, and the central opening 136 is inclined to the bore axis 10. A linear profile, a stepped profile, or some other profile is acceptable for the central opening 136. A conduit 144 is connected to the baffle structure 126 between the central opening 136 and the baffle wall segment 124 and has a mouth 144*a* that is open from the rear as shown in this orientation. An exit 144*b* of the conduit 144 is directed crosswise to the bore axis 10. Due to the converging geometry of the conduit 144 from the mouth 144*a* to the exit 144*b*, gases entering the conduit 144 from the mouth 144*a* are directed to pass through the exit 144*b* in a direction that is perpendicular or substantially perpendicular (e.g., ±10°) to the bore axis 10.

The final baffle segment 120*d* includes a plurality of conduits 150 along an inside of the conical section of the baffle wall segment 124, where the conduits 150 have an open proximal end 150*a* and an open distal end 150*b*. A portion of gases flowing through final baffle segment 120*d* passes through the conduits 150 and is directed into radially outer portions of the flash hider 201 in the end cap 200. In some embodiments, the final baffle segment 120*d* includes part of the flash hider 201. For example, the conical portion of the baffle wall segment 124 and conduits 150 define, at least in part, the flash hider 201. In one such example, the end cap 200 has a circular plate that defines a central opening to accommodate or receive the conical portion of the baffle wall segment 124.

The conical portion of the baffle wall segment 124 defines one or more ports 128 that enable gas flow between the inner volume 108 and outer volume 109. During the firing cycle, for example, gases can flow from the outer volume 109 to the inner volume 108, or vice versa, through ports 128 in the final baffle segment 120*d*. In this example, ports 128 in the final baffle 120*d* are located in the vertex 132 of diverging vanes. The outer volume 109 pressurizes before gases flowing along the central axis flow in the inner volume 108 reach the distal end of the suppressor 100, thus the higher pressure gasses in the outer volume 109 near the volume adjacent to the endcap flow into the inner volume 108 and the flash hider outer volumes 222*b* via ports 128, at least during some portions of the firing cycle.

In the examples shown in FIGS. 4-8, the baffle structures 126 have a linear taper. In other embodiments, the baffle structure 126 of one or more of the baffle segments can have a stepped profile or other non-linear taper (e.g., curved). In some embodiments, the baffle structure 126 can have a polygonal cross-sectional shape, such as a rectangle, hexagon, or star.

When baffle segments 120*a*-120*d* shown in the example of FIG. 4 are assembled sequentially with each baffle being 180° out of phase with the preceding baffle, namely, that the conduit 144 of one baffle segment 120 is 180° out of phase with the conduit 144 of a preceding and/or subsequent baffle 120, gases can flow along a sinuous flow path through the assembly and so that gas flow within the inner volume 109 crosses the bore axis 10. This sinuous flow pattern can occur along a vertical plane or other plane as desired. Gas ports 128 in the baffle wall segment 124 can enhance off-axis flow (e.g., sinuous flow) by reinforcing that flow path. Sample gas flow paths are discussed in more detail below.

Figure 9A:
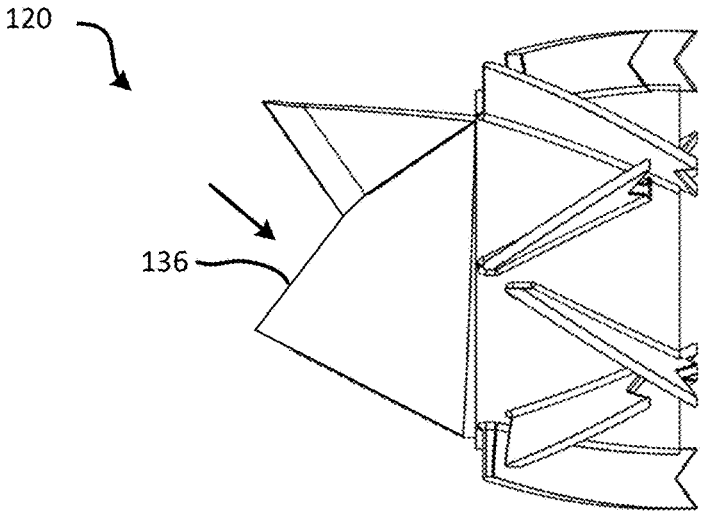
FIGS. 9A-9C illustrate side views of baffle sections of a baffle stack and show various profiles of central openings, in accordance with some embodiments of the present disclosure.
Figure 9B:
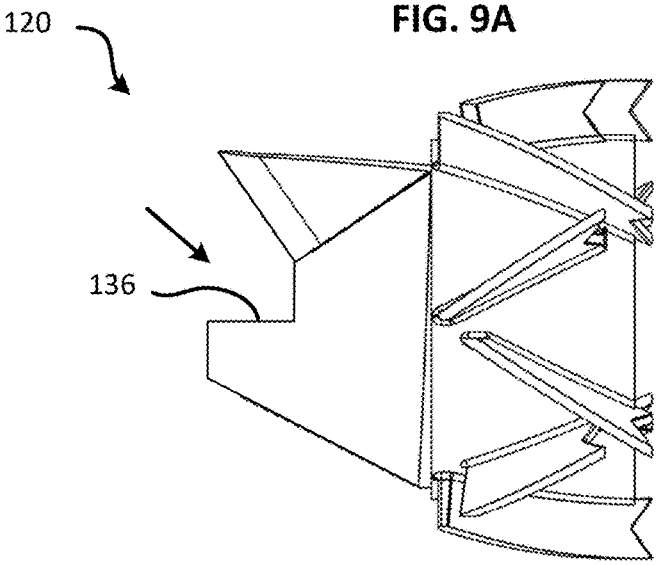
Figure 9C:
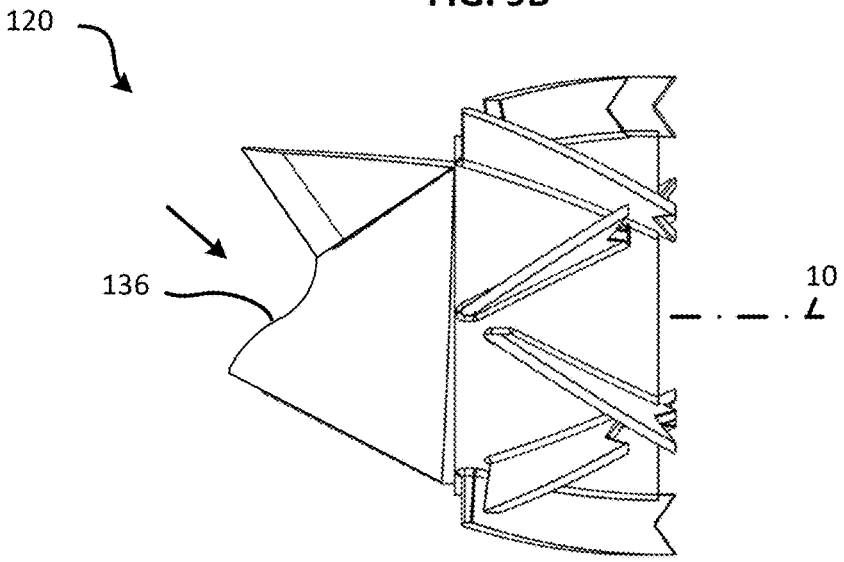

FIGS. 9A-9C illustrate side views of baffle stack sections 120. In each case, the central opening 136 has a non-circular shape as viewed in a direction perpendicular to the largest area of the central opening 136, and has a circular shape as viewed along the bore axis 10. In FIG. 9A, the central opening is inclined to the bore axis 10 (e.g., 40-60°) and has an ovoid or elliptical shape as viewed perpendicular to the central opening 136. In FIG. 9B, the central opening 136 has a stepped shape as viewed from the side and has an oval or racetrack shape as viewed perpendicular to the central opening 136. In FIG. 9C, the central opening 136 has a sinuous profile as viewed from the side and has an ovoid shape as viewed perpendicular to the central opening. The size of the central opening 136 is generally circular when viewed along the bore axis and has a smaller area than the size of the central opening 136 when viewed at an oblique, transverse direction in which case the central opening 136 is non-circular. This proportionally larger opening in the transverse direction to the bore axis 10 allows for less restrictive gas flow, thus promoting a sinuous flow path.

Figure 10A:
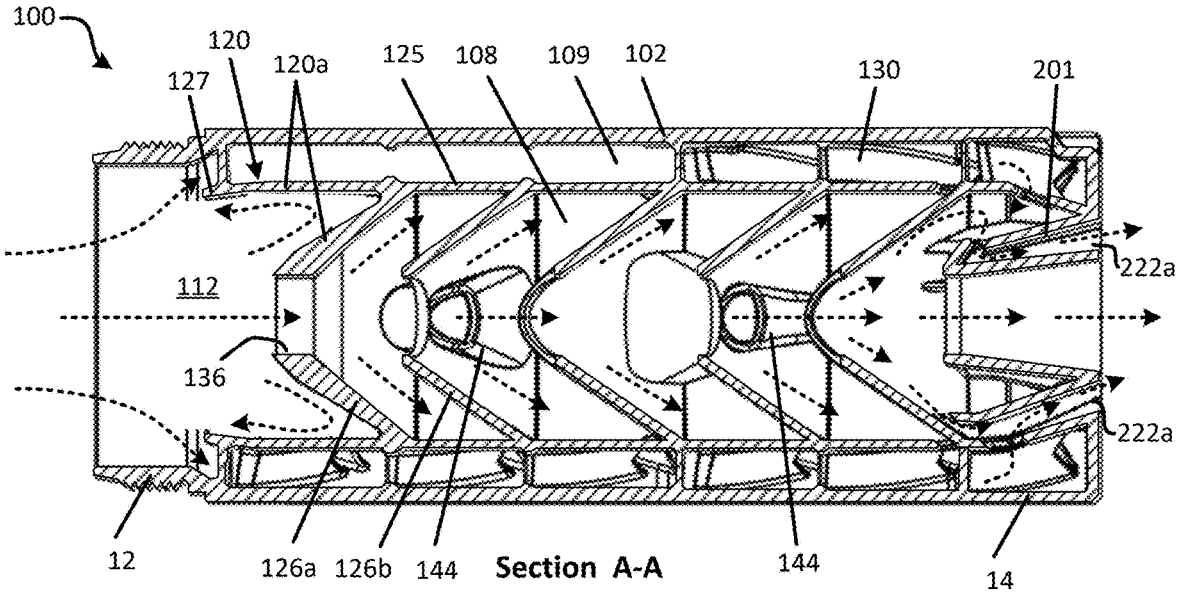
FIG. 10A illustrates a longitudinal section of a suppressor as viewed along line A-A of FIG. 1, in accordance with an embodiment of the present disclosure.
Figure 10B:
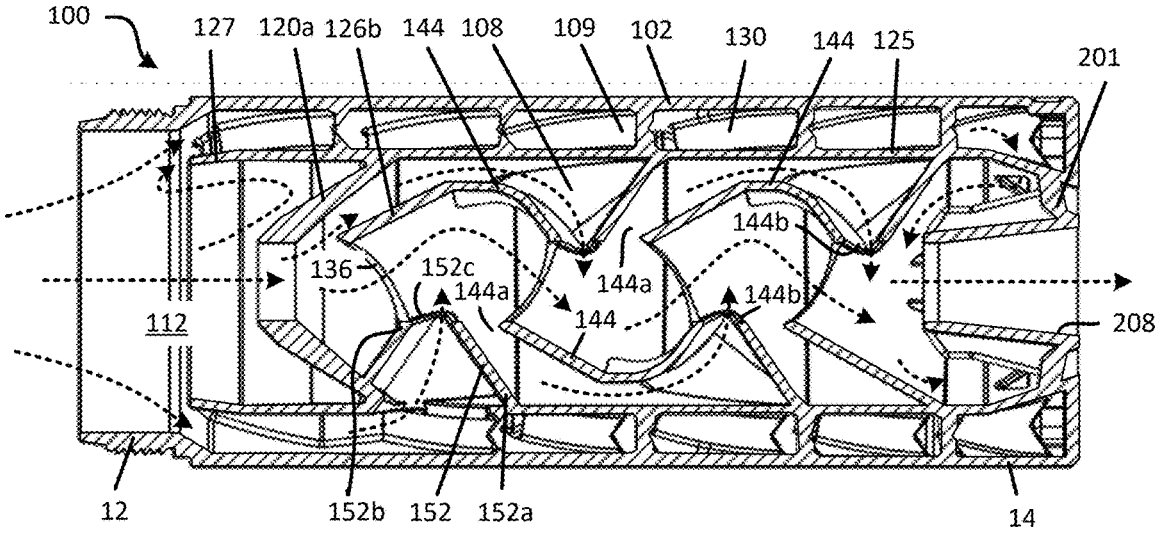
FIG. 10B illustrates a longitudinal section of a suppressor as viewed along line B-B of FIG. 1, in accordance with an embodiment of the present disclosure.

Referring now to FIGS. 10A and 10B, longitudinal sections of a suppressor 100 are shown in accordance with an embodiment of the present disclosure. FIG. 10A illustrates a longitudinal section as viewed along line A-A of FIG. 1, and FIG. 10B is a longitudinal section as viewed along line B-B of FIG. 1; section A-A is taken 90° to that of Section B-B. Broken lines and arrows in these figures represent example gas flow paths. Note, however, that the arrows are for illustration only and may not represent all gas flows and may not accurately represent changes in gas flow patterns that may occur throughout the firing cycle. The suppressor 100 defines an inner volume 108 radially inside of the baffle stack wall 125. The suppressor 100 defines an outer volume 109 between the baffle stack wall 125 and the outer housing 102.

As pressurized gases enter the suppressor 100, the gases expand initially into the blast chamber 112, which is between the proximal end portion 12 and a proximal end portion 127 of the baffle stack 120. A first portion of gases flows into the inner volume 108 via the central opening 136 of the first baffle structure 126*a*. A second portion of gases flows into the outer volume 109 by flowing around the proximal end portion 127 of the blast baffle 120*a*. After entering the outer volume 109, gases generally continue to flow towards the distal end portion 14 where these gases vent through the flash hider 200.

A proximal port 128*a* in the baffle wall 125 is positioned to direct gases from the outer volume 109 into the inner volume 108 in a direction crosswise (e.g., perpendicular) to the bore axis 10. The proximal port 128*a* is located distally of where the blast baffle 120*a* connects to the baffle wall 125. A funnel 152 is arranged to receive gases flowing through the proximal port 128*a*. The funnel 152 has a larger first end 152*a* connected to the baffle wall 125 and tapers in a radially inward direction to a smaller second end 152*b* with an exit opening 152*c* that directs gases crosswise to the bore axis 10. For example, a plane of the exit opening 152*c* is oriented parallel to the bore axis 10. The central opening 136 of the second baffle structure 126*b* is inclined to the bore axis 10 to direct gases across the bore axis 10, which is downward in this example. Conduits 144 extend rearward from baffle structures 126 and terminate in a funnel-like structure that directs gases in the radially outer portion to exit the funnel-like structure in a direction crosswise to the bore axis 10.

For gases flowing through the inner volume 108, individual features of the baffle stack 120 can be included to promote flow in a direction across the bore axis 10 and disrupt gas flow along the bore axis 10. In combination, these features promote one or more sinuous or non-linear gas flow paths through the inner volume 108. Gases flowing through the outer volume 109 take a non-linear path due to collisions with flow-directing structures 130.

The suppressor 100 can also include features that result in reduced backpressure, which reduces the flow of gases back through the barrel and receiver during the firing cycle. One such feature is conduits 144 that connect adjacent baffle structures 126 and that allow gases to pass from one baffle to the next in the radially outer portion of the inner volume 108. Another feature is the proximal port 128*a* and other ports 128 that allows gases to flow from the outer volume 109 to the inner volume 108 and vice versa. Another feature is central openings 136 of baffle structures 126 that are inclined to the bore axis 10 or otherwise have a greater area in a direction other than as viewed along the bore axis 10. For example, some central openings 136 are in a plane oriented at an angle of 30-60 degrees with respect to the bore axis 10. Since gases tend to flow through the largest area of an opening (i.e., perpendicular to the opening), gas flow through these central openings 136 promotes off-axis flow. Further, a flash hider 201 is configured to vent gases from the outer volume 109 either directly or after first entering the inner volume 108 with less flow restriction than traditional baffle suppressors featuring a central opening only.

As best seen in FIG. 10B, conduits 144 promote off-axis gas flows. For example, after entering the outer volume 109, a portion of gases flow through the funnel 152 that directs gases across the central axis 10 in a direction that is substantially perpendicular to the central axis 10. Gases flowing in an off-axis direction through central openings 136 are intersected by gases flowing through a conduit 144 immediately downstream from a given central opening 136. In the distal end portion 14, gases can exit the inner volume 108 along the central axis 10 through the central opening 208 of the first flash hider portion 216, can expand around the flash hider 201 and exit through radially outer volumes 222*a* of the second flash hider portion 220 (shown in FIG. 10A). As seen in FIG. 10A, gases in the outer volume 109 can enter the inner volume 108 via ports 128 and indirectly exit the flash hider 201 through the central opening 208 and the flash hider outer volumes 222*a*, or directly enter the flash hider outer volumes 222*b* via the adjacent ports 128 and exit the suppressor.

For gases in the outer volume 109, vanes 130 arranged in diverging and converging pairs increase turbulence and force a tortuous flow path to the distal end portion 14. Collisions with the vanes and other flow-directing structures 130 result in energy loss and transfer of heat from the gases. Conduits 144 on opposite sides of the inner volume 108 are positioned sequentially to amplify a sinuous or alternating gas flow path through the inner volume 108. The conduits 144 direct gases through the crossflow opening 142 in the baffle structure 126 and across the bore axis 10.

Figure 11A:
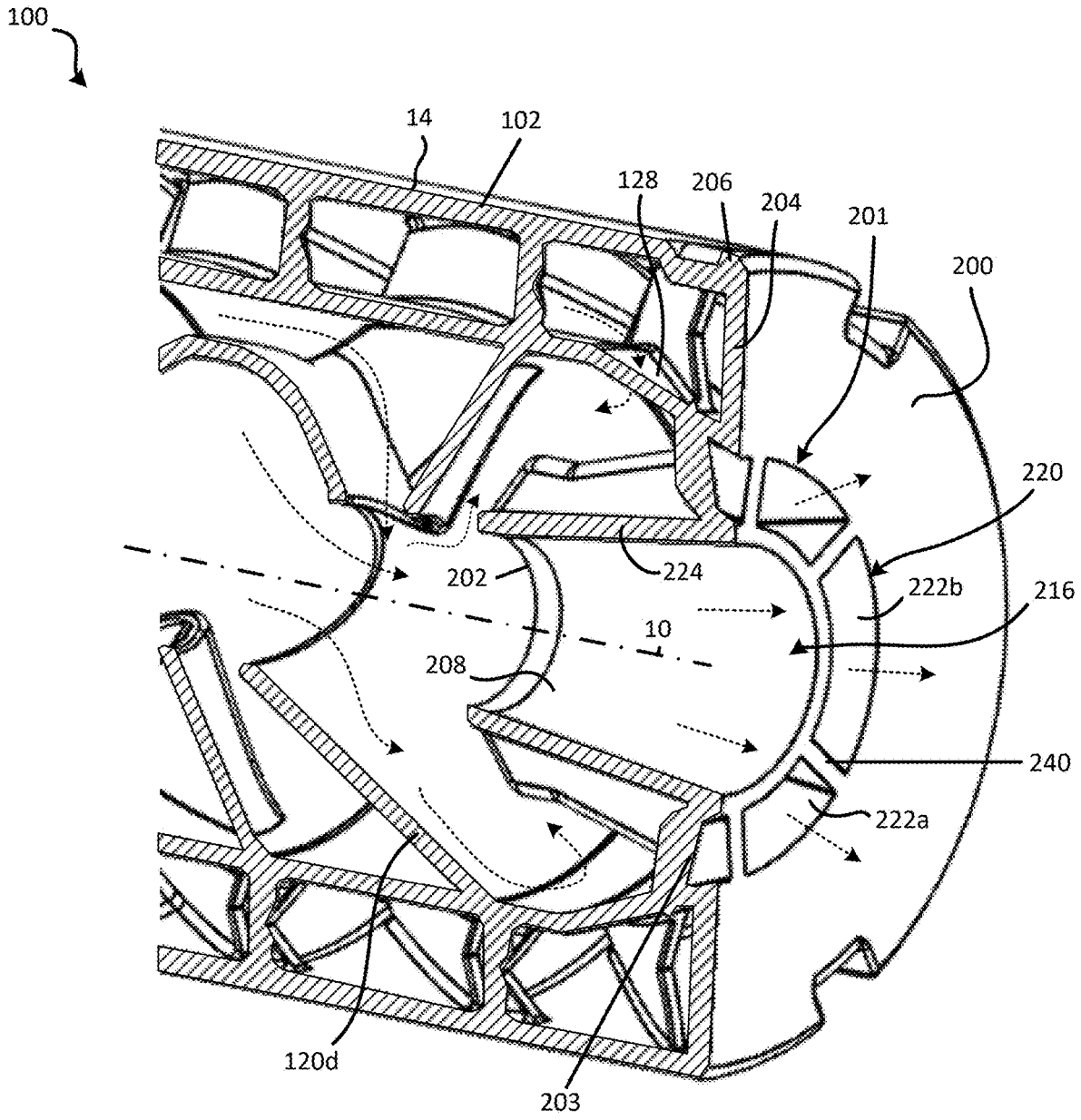
FIGS. 11A and 11B illustrate a perspective views showing longitudinal sections of a distal end portion of a suppressor with an end cap configured as a flash hider, in accordance with embodiments of the present disclosure.
Figure 11B:
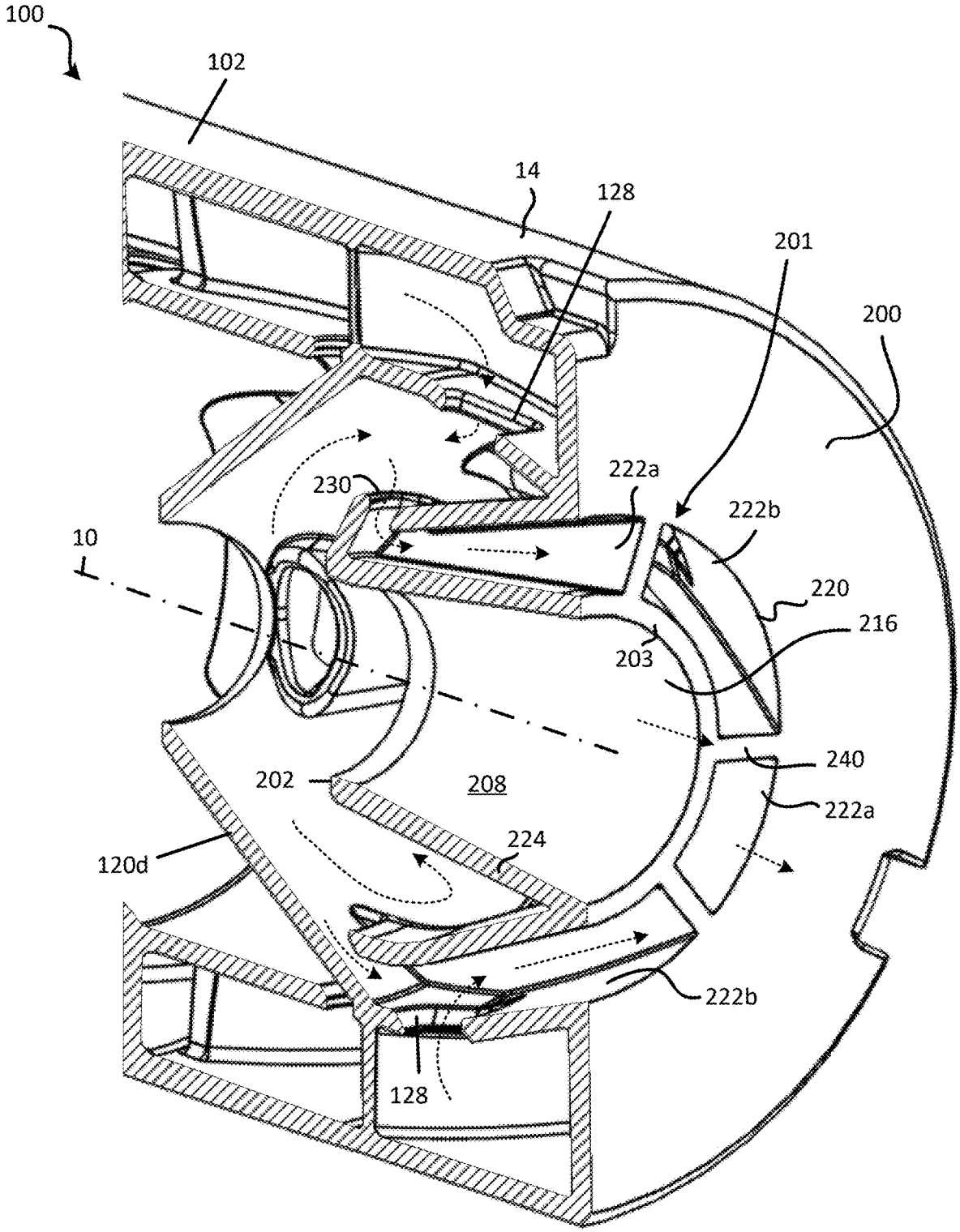

Referring now to FIGS. 11A and 11B, perspective views show longitudinal sections of a distal end portion 14 of a suppressor 100 that includes an endcap 200 with an integral flash hider 201. The flash hider 201 extends along the bore axis 10 from a proximal end 202 to a distal end 203 and includes a first flash hider portion 216 and a second flash hider portion 220. The second flash hider portion 220 is arranged radially outside of the first flash hider portion 216 and arranged coaxially with the first flash hider portion 216.

The first flash hider portion 220 consists of a central opening 208 that extends along and includes the bore axis 10, where the central opening 208 expands in size moving from the proximal end 202 to the distal end 203. In these examples, the central opening 208 has a frustoconical geometry with a wall 224 separating the central opening 208 of the first flash hider portion 216 from the second flash hider portion 220. The wall 224 defines an expanding volume of the first flash hider portion 216 as it extends distally. The wall 224 directs propellant gases away from the bore axis 10 and limits the expansion of the propellant gases. In some embodiments, the wall 224 has a frustoconical shape. In some embodiments, the wall 224 defines an angle with the bore axis 10 from 4-15°, including 5-8°, or 6-7°, for example. Such a value for the inner wall angle has been found to slow down propellant gases exiting to the environment as well as to reduce the amount of hot propellant gases that mix with ambient air/oxygen. In other embodiments, the wall 224 (or portions thereof) can have a linear or non-linear taper between the distal end 203 and the proximal end 202. Examples of a non-linear taper include a curved (e.g., elliptical or parabolic) or a stepped profile. In other embodiments, the wall 224 can have some other cross-sectional shape, such as a square, rectangle, hexagon, or other polygonal or elliptical shape.

The second flash hider portion 220 includes a plurality of radially outer volumes 222*a*, 222*b* that are distributed circumferentially around the central opening 208. As shown in FIG. 11B, gases can enter the radially outer volumes 222*a* at openings 230 at the top wall of the proximal end 202 of the flash hider. In some embodiments, some or all of the radially outer volumes 222*a* define additional openings along their length. In some embodiments, such as shown, each of the radially outer volumes 222*a*, 222*b* expand in volume moving distally. In other embodiments, some or all of the radially outer volumes 222*a*, 222*b* can have a uniform volume along their length. Circumferentially adjacent radially outer volumes 222*a*, 222*b* are separated by a partition 240, thereby defining distinct radially outer volumes 222.

The first flash hider portion 216 vents a first portion of gases that enter the flash hider 200 through the central opening 208. For example, the first flash hider portion 216 vents gases flowing through the inner volume 108 along the bore axis 10. The second flash hider portion 220 vents a second portion of gases that enter the flash hider 200 through openings 230 at the radially outer face at the proximal end 202 of the flash hider 201. For example, the second flash hider portion 220 vents gases in the radially outer portion of the inner volume 108 and/or vents gases from the outer volume 109 after they pass into the inner volume 108 via ports 128. As shown, gases from the outer volume 109 can flow into the inner volume 108 via ports 128 in the final baffle 120*d* and then exit via the flash hider 201. Thus, in this example, the second flash hider portion 220 vents gases from both the outer volume 109 and the inner volume 108 that entered the flash hider outer volumes 222*a*.

In another example, gasses in the outer volume 109 can enter flash hider outer volumes 222*b* directly via alternate ports 128 in the final baffle 120*d*. For example, outer volumes 222*b* of the second flash hider portion 220 directly vent gasses from the outer volume 109.

In this example, the flash hider 201 is part of the end cap 200. The end cap 200 includes distal wall 204 configured like a flange that extends radially outward from the distal end 203 of the flash hider 201. In some embodiments, the rim 206 of the endcap 200 can be connected to the outer housing 102, such as by welding, a frictional fit, or a threaded connection. Alternately, the endcap 200 and flash hider 201 can be made as a single component with the baffle stack 120 by additive manufacturing techniques, for example.

One advantage of venting gases through the radially outer volumes 222 is to reduce the pressure of the gases flowing along the bore axis 10. In doing so, flash can be reduced. Venting through the second flash hider portion 220 also can reduce the pressure in the suppressor 100 and therefore reduce the back flow of gases into the firearm's chamber, such as when the suppressor 100 is used with semi-automatic or automatic rifles. Further, isolating the gas flow through the second flash hider portion 220 from the first flash hider portion 216 can inhibit or reduce mixing and turbulence of gases exiting the flash hider 200, and therefore reduce the visible signature of the firearm.

In some embodiments, radially outer volumes 222*a*, 222*b* are constructed to prevent a line of sight into the suppressor 100. For example, openings 230 into radially outer volumes 222*a* are positioned on a radially outer wall at the proximal end 202 of the flash hider 201 and oriented to prevent a line-of-sight into the suppressor 100 through radially outer volumes 222*a*. In one example, openings 230 are generally parallel to the bore axis 10. Openings 230 can have other orientations. Alternately, or in addition, the radially outer volumes 222 can include a bend, twist, or other direction change that prevents a line of sight into the suppressor through radially outer volumes 222 to points rearward of the flash hider. Stated differently, by looking into a radially outer volume 222, one will see only walls defining the radially outer volume 222, but will not see the inner volume 108, the outer volume 109, or structures beyond the flash hider 201.

FURTHER EXAMPLE EMBODIMENTS

The following examples pertain to further embodiments, from which numerous permutations and configurations will be apparent.

Example 1 is a suppressor that includes a tubular housing extending along a bore axis from a proximal end to a distal end. A baffle stack is positioned within the hollow tubular housing and extends along the bore axis from a proximal baffle stack end to a distal baffle stack end. The baffle stack has a tubular baffle wall with a plurality of baffle structures connected to an inside of the tubular baffle wall and individual baffle structures tapering proximally to a central opening on the bore axis. The suppressor defines an inner volume inside of the tubular baffle wall and an outer volume between the tubular baffle wall and the hollow tubular housing. Flow-directing structures in the outer volume include pairs of diverging vanes and pairs of converging vanes with respect to gases flowing distally through the suppressor. A conduit extends between and connects adjacent baffle structures, where the conduit defines a gas flow pathway in a radially outer portion of the inner volume and the conduit defines an opening located between the adjacent baffle structures and configured to direct gas flow across the bore axis.

Example 2 includes the suppressor of Example 1, where the plurality of baffle structures includes a blast baffle adjacent a proximal end of the baffle wall, the blast baffle having a frustoconical shape and defining a central opening on the bore axis. The blast baffle connects to the baffle wall distally of the proximal end of the baffle wall.

Example 3 includes the suppressor of Example 1 or 2, wherein an entirety of the blast baffle is located distally of the proximal baffle stack end.

Example 4 includes the suppressor of any one of Examples 1-3, where the baffle wall defines a proximal port located adjacent a connection of the blast baffle to the baffle wall and is configured to direct gases from the outer volume to the inner volume.

Example 5 includes the suppressor of Example 4 and includes a funnel having a larger first end arranged to receive gases flowing through the proximal port and tapering to smaller a second end defining an exit opening. The funnel is configured and arranged to direct gases from the proximal port through the exit opening in a direction crosswise to the bore axis, wherein an area of the exit opening is 20%-40% of an area of the proximal port.

Example 6 includes the suppressor of Example 5, where the funnel is configured to direct gases perpendicularly to the bore axis.

Example 7 includes the suppressor of any one of Examples 4-6, where the proximal port is located between converging vanes.

Example 8 includes the suppressor of any one of Examples 2-7, where the proximal port has an area from 100% to 400% of an area of the central opening of the blast baffle.

Example 9 includes the suppressor of Example 8, where the area of the proximal port is from 125% to 250% of an area of the central opening of the blast baffle.

Example 10 includes the suppressor of any one of Examples 1-9, where the suppressor has a length of not more than seven inches and has an outer diameter not more than 2.5 inches.

Example 11 includes the suppressor of any one of Examples 1-10, wherein the central opening of at least some of the baffle structures has a non-circular shape as viewed perpendicular to a plane of the central opening and has a circular shape as viewed along the bore axis, and where an area of the non-circular shape is larger than an area of the circular shape.

Example 12 includes the suppressor of Example 11, where the central opening has an ovoid shape.

Example 13 includes the suppressor of Example 11 or 12, where the central opening has a stepped profile as viewed from a side of the bore axis.

Example 14 includes the suppressor of Example 13, where the central opening has a first semicircular portion and a second semicircular portion that is axially offset from the first semicircular portion, wherein the first semicircular portion and the second semicircular portion combine to define the central opening of circular shape as viewed along the bore axis.

Example 15 includes the suppressor of any one of Examples 1-14, where the pairs of converging vanes and the pairs of diverging vanes define a zig-zag pattern around an outside of the tubular baffle wall.

Example 16 includes the suppressor of Example 15, where individual vanes of the pairs of converging vanes and pairs of diverging vanes have a helical shape.

Example 17 includes the suppressor of any one of Examples 1-16 and further includes a flash hider in fluid communication with the baffle stack, where the flash hider is connected to the distal end of the hollow tubular housing.

Example 18 includes the suppressor of Example 17, where the flash hider includes a first flash hider portion comprising a central opening and that expands in volume moving distally along the bore axis, and where the flash hider includes a second flash hider portion positioned radially outside of the first flash hider portion.

Example 19 is a suppressor that includes a tubular outer housing extending along a bore axis from a proximal end to a distal end and a baffle stack within the hollow tubular housing and extending along the bore axis. The baffle stack has a tubular baffle wall with a plurality of baffle structures connected to an inside of the tubular baffle wall and individual baffle structures tapering proximally to a central opening on the bore axis. The baffle structures include a blast baffle in a proximal portion of the baffle wall, where at least a majority portion of the blast baffle is positioned distally of a proximal end of the baffle wall. The suppressor defines an inner volume inside of the baffle wall, and an outer volume between the baffle wall and the outer housing. Flow-directing structures are in the outer volume. An end cap is connected to a distal end of the outer housing and defines a central passageway that expands along the bore axis.

Example 20 includes the suppressor of Example 19 and defines a conduit extending between and connecting adjacent baffle structures, where the conduit defines a gas flow pathway in a radially outer portion of the inner volume and the conduit defines an opening located between the adjacent baffle structures and configured to direct gas flow across the bore axis.

Example 21 includes the suppressor of Example 19 or 20, where the flow-directing structures including pairs of diverging vanes and pairs of converging vanes with respect to gases flowing distally through the suppressor.

Example 22 includes the suppressor of any one of Example 19-21, where a proximal end portion of the baffle wall defines a proximal port between a pair of converging vanes, the proximal port configured and arranged to direct gases from the outer volume into the inner volume in a direction that is crosswise to the bore axis.

Example 23 includes the suppressor of Example 22 and further includes a funnel having a larger first end arranged to receive gases flowing through the proximal port and tapering to smaller a second end defining an exit opening. The funnel is configured and arranged to direct gases from the proximal port through the exit opening.

Example 24 includes the suppressor of Example 23, where funnel is configured to direct gases in a direction that is perpendicular to the bore axis.

Example 25 includes the suppressor of Example 22, where the proximal port has an area from 100% to 400% of an area of the central opening of the blast baffle.

Example 26 includes the suppressor of Example 25, where the area of the proximal port is from 125% to 250% of the area of the central opening of the blast baffle.

Example 27 includes the suppressor of any one of Examples 19-26, where the central opening of at least some of the baffle structures has a non-circular shape as viewed perpendicular to a plane of the central opening and has a circular shape as viewed along the bore axis, and where an area of the non-circular shape is larger than an area of the circular shape.

Example 28 includes the suppressor of Example 27, where the central opening of the at least some baffle structures defines a step as viewed from a side of the suppressor, the step defining a first portion of the central opening that is spaced axially from an opposite second portion of the central opening.

Example 29 includes the suppressor of Example 27 or 28, where the central opening of at least some baffle structures has an ovoid shape.

Example 30 includes the suppressor of any one of Examples 19-29, where (i) the end cap is configured as a flash hider, (ii) the central passageway is a first flash hider portion configured to vent a first portion of gases directly from the inner volume, and (iii) a second flash hider portion is arranged radially outside of and concentric with the central passageway, the second flash hider portion in direct fluid communication with a distal end portion of the outer volume, the second flash hider portion arranged concentrically with and radially between the tubular baffle and the central passageway.

Example 31 includes the suppressor of any one of Examples 19-30, where the suppressor has a length of not more than seven inches and has an outer diameter not more than 2.5 inches.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

The invention claimed is:

1. A suppressor comprising:

a tubular housing extending along a bore axis from a proximal end to a distal end;

a baffle stack within the tubular housing and extending along the bore axis from a proximal baffle stack end to a distal baffle stack end, wherein the baffle stack comprises a tubular baffle wall extending along the bore axis and arranged concentrically with the tubular housing;

baffle structures retained inside of the tubular baffle wall, wherein the suppressor defines an inner volume inside of the tubular baffle wall, and an outer volume between the tubular baffle wall and the tubular housing; and a conduit extending between and connecting adjacent baffle structures, wherein the conduit defines a gas flow pathway in a radially outer portion of the inner volume and with an opening located between the adjacent baffle structures, and wherein the opening is arranged to direct gas flow across the bore axis.

2. The suppressor of claim 1, wherein the baffle structures include a blast baffle adjacent a proximal end of the tubular baffle wall.

3. The suppressor of claim 2, wherein an entirety of the blast baffle is located distally of the proximal baffle stack end.

4. The suppressor of claim 2, wherein the tubular baffle wall defines a proximal port located adjacent a connection between the blast baffle and the tubular baffle wall, wherein the port is configured and arranged to direct gases from the outer volume to the inner volume.

5. The suppressor of claim 4, further comprising a funnel having a larger first end arranged to receive gases flowing through the proximal port and tapering to a smaller second end defining an exit opening, wherein the funnel is configured and arranged to direct gases from the proximal port through the exit opening in a direction transverse to the bore axis.

6. The suppressor of claim 5, wherein funnel is configured to direct gases perpendicularly to the bore axis.

7. The suppressor of claim 6, further comprising a pair of converging vanes in the outer volume, wherein the proximal port is located between the pair of converging vanes.

8. The suppressor of claim 4, wherein the proximal port has an area from 100% to 400% of an area of the central opening of the blast baffle.

9. The suppressor of claim 1, wherein the central opening of at least some of the baffle structures has a non-circular shape as viewed perpendicular to a plane of the central opening and has a circular shape as viewed along the bore axis, and wherein an area of the non-circular shape is larger than an area of the circular shape.

10. The suppressor of claim 1, further comprising:

a flash hider in fluid communication with the baffle stack and connected to the distal end of the tubular housing, the flash hider having a first flash hider portion, and having a second flash hider portion positioned radially outside of the first flash hider portion and in direct fluid communication with the outer volume.

11. A suppressor comprising:

a tubular outer housing extending along a bore axis from a proximal end to a distal end; and a baffle stack concentrically arranged within the tubular outer housing and extending along the bore axis, the baffle stack comprising a tubular baffle wall with baffle structures connected to an inside of the tubular baffle wall;

wherein the baffle structures include a blast baffle positioned distally of a proximal end of the tubular baffle wall, wherein the suppressor defines an inner volume inside of the tubular baffle wall, and an outer volume between the tubular baffle wall and the tubular outer housing, and wherein a proximal end portion of the tubular baffle wall defines a proximal port configured and arranged to direct gases from the outer volume to the inner volume in a direction that is transverse or rearward and transverse with respect to the bore axis.

12. The suppressor of claim 11, comprising a conduit extending between and connecting adjacent baffle structures.

13. The suppressor of claim 12, wherein the conduit defines a gas flow pathway in a radially outer portion of the inner volume and wherein the conduit defines an opening located between the adjacent baffle structures and arranged to direct gas flow across the bore axis.

14. The suppressor of claim 13, comprising a pair of converging vanes in the outer volume, wherein the proximal port is arranged between the pair of converging vanes.

15. The suppressor of claim 13, further comprising a funnel having a larger first end arranged to receive gases flowing through the proximal port and tapering to smaller a second end defining an exit opening.

16. The suppressor of claim 15, wherein funnel is configured to direct gases across the bore axis.

17. The suppressor of claim 13, wherein the proximal port has an area from 100% to 400% of an area of the central opening of the blast baffle.

18. The suppressor of claim 17, wherein the area of the proximal port is from 125% to 250% of the area of the central opening of the blast baffle.

19. The suppressor of claim 11, wherein the central opening of at least some of the baffle structures has a non-circular shape as viewed perpendicular to a plane of the central opening, and has a circular shape as viewed along the bore axis, wherein an area of the non-circular shape is larger than an area of the circular shape.

20. The suppressor of claim 11, further comprising:

an end cap connected to the distal end of the tubular outer housing, wherein the endcap is configured as a flash hider.

* * * * *